US010287817B2

(12) United States Patent
Jones et al.

(10) Patent No.: US 10,287,817 B2
(45) Date of Patent: May 14, 2019

(54) PANEL SEAL SYSTEMS

(71) Applicant: Modernfold, Inc., Greenfield, IN (US)

(72) Inventors: Brad Jones, Anderson, IN (US); Aaron Alexander, Indianapolis, IN (US); Phil Middaugh, Indianapolis, IN (US); Mark McDonough, Carmel, IN (US); Adam Burke, Greenfield, IN (US); Mike Beeler, Anderson, IN (US); Robert K. Schuyler, Lapel, IN (US); Philip M. Watson, Indianapolis, IN (US); Matthew Puccio, Peosta, IA (US); Thomas L. Goldsmith, Earlville, IA (US); Bryan T. Welch, Noblesville, IN (US)

(73) Assignee: Modernfold, Inc., Greenfield, IN (US)

( * ) Notice: Subject to any disclaimer, the term of this patent is extended or adjusted under 35 U.S.C. 154(b) by 0 days.

(21) Appl. No.: 13/799,248

(22) Filed: Mar. 13, 2013

(65) Prior Publication Data

US 2014/0059933 A1 Mar. 6, 2014

Related U.S. Application Data

(60) Provisional application No. 61/696,788, filed on Sep. 4, 2012, provisional application No. 61/697,195, filed on Sep. 5, 2012.

(51) Int. Cl.
*E06B 7/20* (2006.01)
*E05D 15/06* (2006.01)
(Continued)

(52) U.S. Cl.
CPC ..... *E06B 7/20* (2013.01); *E04B 2/827* (2013.01); *E05D 15/0652* (2013.01);
(Continued)

(58) Field of Classification Search
CPC ..... E06B 7/20; E05D 15/26; E05D 15/0652; E04B 2/827
(Continued)

(56) References Cited

U.S. PATENT DOCUMENTS 527,212 A * 10/1894 Morrison ..... 49/306
3,086,261 A * 4/1963 Lapof ..... 49/316
(Continued)

FOREIGN PATENT DOCUMENTS

GB 1093572 12/1967

OTHER PUBLICATIONS

Invitation to Pay Additional Fees and, Where Applicable, Protest Fee, in PCT/US2013/030747, dated Aug. 16, 2013, 6 pages.
(Continued)

*Primary Examiner* — Gregory J Strimbu
(74) *Attorney, Agent, or Firm* — Faegre Baker Daniels LLP

(57) ABSTRACT

A movable wall panel system may include a bottom drop seal assembly that maintains a constant force relative to a floor portion of an environment through a damper. The movable wall panel system may include an automatic top seal assembly that seals a gap between the movable wall panel system and a ceiling of the environment. The moveable wall panel system may include multiple panels and a plurality of seals positioned between adjacent panels to seal a gap between the adjacent panels.

11 Claims, 25 Drawing Sheets

(51) Int. Cl.
*E04B 2/82* (2006.01)
*E05D 15/26* (2006.01)

(52) U.S. Cl.
CPC ..... *E05D 15/26* (2013.01); *E05Y 2800/12* (2013.01); *E05Y 2900/00* (2013.01); *E05Y 2900/142* (2013.01)

(58) Field of Classification Search
USPC ..... 49/306, 307, 310, 316
See application file for complete search history.

(56) References Cited

U.S. PATENT DOCUMENTS 3,126,050 A * 3/1964 Lapof ..... 160/40
3,672,424 A 6/1972 Brown
3,871,133 A * 3/1975 Ellingson, Jr. ..... 49/308
4,141,179 A * 2/1979 Newson et al. ..... 49/316
4,395,854 A 8/1983 White et al.
4,462,192 A 7/1984 Fisher
5,042,555 A 8/1991 Owens
5,152,332 A 10/1992 Siener
5,339,881 A 8/1994 Owens
5,358,023 A 10/1994 Owens
5,467,559 A 11/1995 Owens
5,499,671 A 3/1996 Owens
5,551,499 A 9/1996 McRoberts
5,577,348 A * 11/1996 Keller ..... E04B 2/827 160/40
6,167,937 B1 1/2001 Williams
6,430,779 B1 8/2002 Goldsmith et al.
6,715,530 B2 4/2004 Goldsmith et al.
8,336,257 B2 12/2012 McDonald et al.
8,381,445 B2 2/2013 Hans
8,402,700 B2 3/2013 Hall et al.

OTHER PUBLICATIONS

Modernfold, Acousti-Seal 932FS Owner's Manual, Jan. 2009, 8 pgs.
Modernfold, Acousti-Seal 933E on #14 and #30 Track Owners Manual, Jul. 2010, 5 pgs.
"How Gas Springs Work," retrieved from http://www.indgassprings.com/how-gas-springs-work.html, Jan. 29, 2015.
"Gas Spring Principles," retrieved from http://www.lstechnologies.ca/principles.html, Jan. 28, 2015.

* cited by examiner

PANEL SEAL SYSTEMS

RELATED APPLICATIONS

This application claims the benefit of U.S. Provisional Application Ser. No. 61/696,788, filed Sep. 4, 2012, titled PANEL SEAL SYSTEMS and of U.S. Provisional Application Ser. No. 61/697,195, filed Sep. 5, 2012, titled PANEL SEAL SYSTEMS, the disclosures of which are expressly incorporated by reference herein.

BACKGROUND

The present disclosure relates to movable wall systems operable to partition a large room into a smaller room. More particularly, the present disclosure relates to a movable wall panel system having a plurality of panels with seals.

Operable walls or partitions, also known as movable wall panel systems, find useful applications in a variety of venues such as classrooms, offices, convention facilities, hospitals or the like. In these venues, the operable partitions are often moved along overhead tracks from which the partitions are suspended. The partitions are movable along the tracks to separate or compartmentalize larger rooms or areas into smaller rooms or areas. The operable partitions are typically connected to trolleys that roll within the overhead track. The track is suspended from a support structure which is typically located above the ceiling of a room or area in which the operable partitions are installed.

Operable partitions are typically available in single panel, paired panel, and continuously hinged arrangements. Paired panel systems are hinged together in groups of two panels which are either top supported by an overhead track or floor supported. Continuously hinged panels are connected together in a train so that the panels extend as one complete unit.

BRIEF DESCRIPTION OF THE DRAWINGS

The detailed description particularly refers to the accompanying figures in which.

DETAILED DESCRIPTION OF THE DRAWINGS

Figure 1:
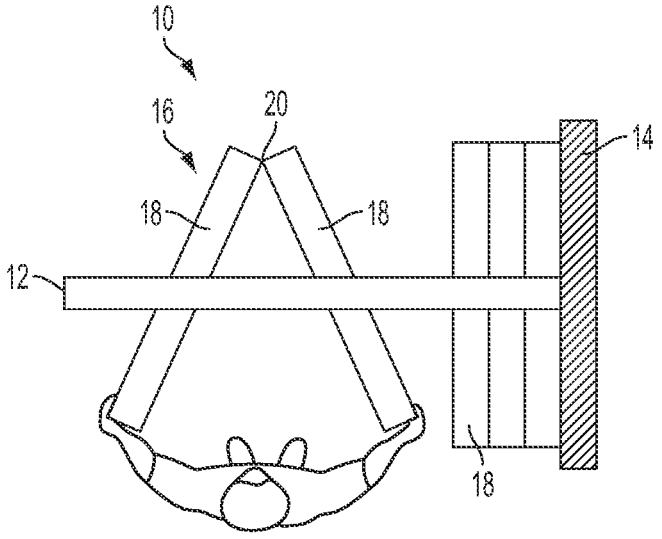
FIG. 1 is a diagrammatical view illustrating a paired panel operable partition.

For the purposes of promoting an understanding of the principles of the present disclosure, reference is now made to the embodiments illustrated in the drawings, which are described below. The embodiments disclosed below are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. The present system and method includes any alterations and further modifications of the illustrated devices and described methods and further applications of the principles of the present disclosure which would normally occur to one skilled in the art to which the present disclosure relates. Corresponding reference characters indicate corresponding parts throughout the several views.

The present disclosure relates to movable walls including self supported wall systems, operable partitions or demountable wall systems, for example, that may be erected in an environment such as in a room of a building.

In one embodiment, an overhead truss is used to support an overhead track in the ceiling of the room. Referring to FIG. 1, a paired panel wall system 10 is shown. The paired panel wall system 10 includes a track 12 which supports movable wall panels 18 of the wall system 10 in a conventional manner. Floor supported panels may also be used.

In one illustrated embodiment, panels 18 of the movable wall system 10 are suspended from the track 12 such that they are movable between a folded (stored) position and an extended (use) position. Referring to FIG. 1, a first movable wall system 10 located adjacent a wall 14 is shown having paired panel segments 16 including two panels 18 connected by a hinge portion 20. Each two-panel segment 16 is unfolded and attached to an adjacent two-panel segment 16 to form a wall.

Figure 2:
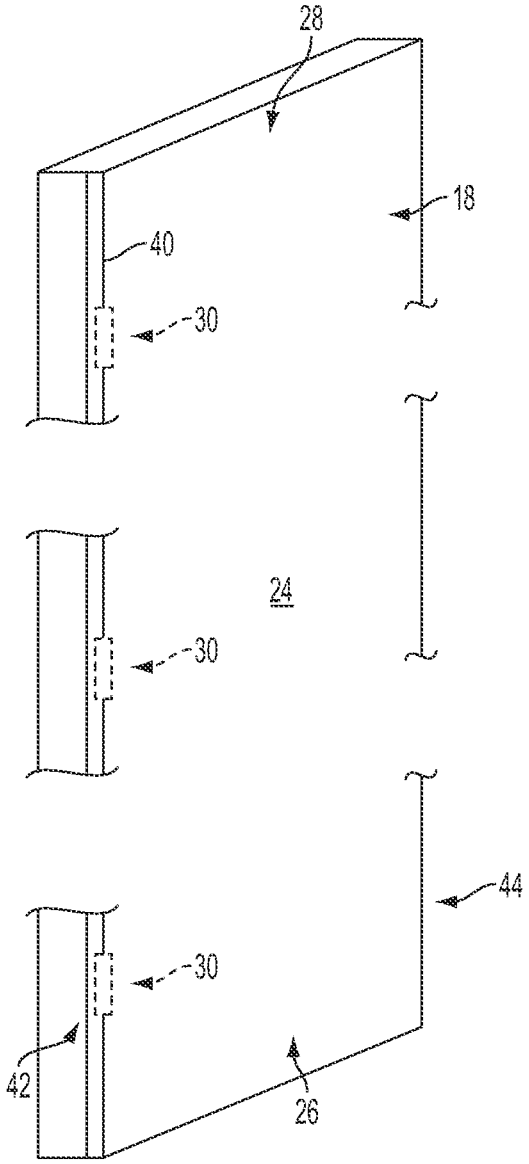
FIG. 2 illustrates an exemplary panel of the paired panel partition of FIG. 1, the exemplary panel including a plurality of spaced apart hinges to couple the exemplary panel to an adjacent panel.

Referring to FIG. 2, an exemplary panel 18 is shown. Panel 18 includes a frame (see frames 22A and 22B in FIG. 3) and a panel face 24. The panel face 24 of panel 18 is arranged to be generally coplanar with the panel faces 24 of adjacent panels to form a wall or partition. Each panel 18 includes a front panel face and a rear panel face. Panel 18 includes a bottom portion 26 and a top portion 28. As explained herein, bottom portion 26 may be coupled to a drop seal assembly which seals a gap between the bottom portion 26 of panel 18 and a floor of the surrounding environment. Exemplary floors include concrete surfaces, metal surfaces, wood surfaces, carpeted surfaces, and any other suitable surfaces for supporting objects thereon. Additionally as explained herein, top portion 28 may be coupled to a top seal assembly which seals a gap between the top portion 28 of panel 18 and a ceiling of the surrounding environment. Exemplary ceilings include concrete surfaces, metal surfaces, wood surfaces, and any other suitable surfaces positioned above the floor.

Returning to FIG. 2, panel 18 is coupled to a plurality of hinges 30 which couple pairs of panels 18 together. The hinges 30 permit the respective panels to pivot relative to each other between a folded (stored) position and an extended (use) position. An exemplary stored position is wherein the panels are arranged panel face to panel face (see FIG. 1). An exemplary use position is wherein the panels are arranged such that the panel faces 24 are generally coplanar.

Panel 24 also includes a seal 40 extending along a first end 42 of panel 18 from the top of the panel 18 to the bottom of the panel 18. A second seal 40 may also extend along a second end 44 of panel 18. As shown in FIG. 2, the seal extends from a position above a respective hinge 30 to a position below the respective hinge 30. In one embodiment, the seal 40 is a continuous seal that extends from the top of the panel 18 to the bottom of the panel 18.

Figure 3:
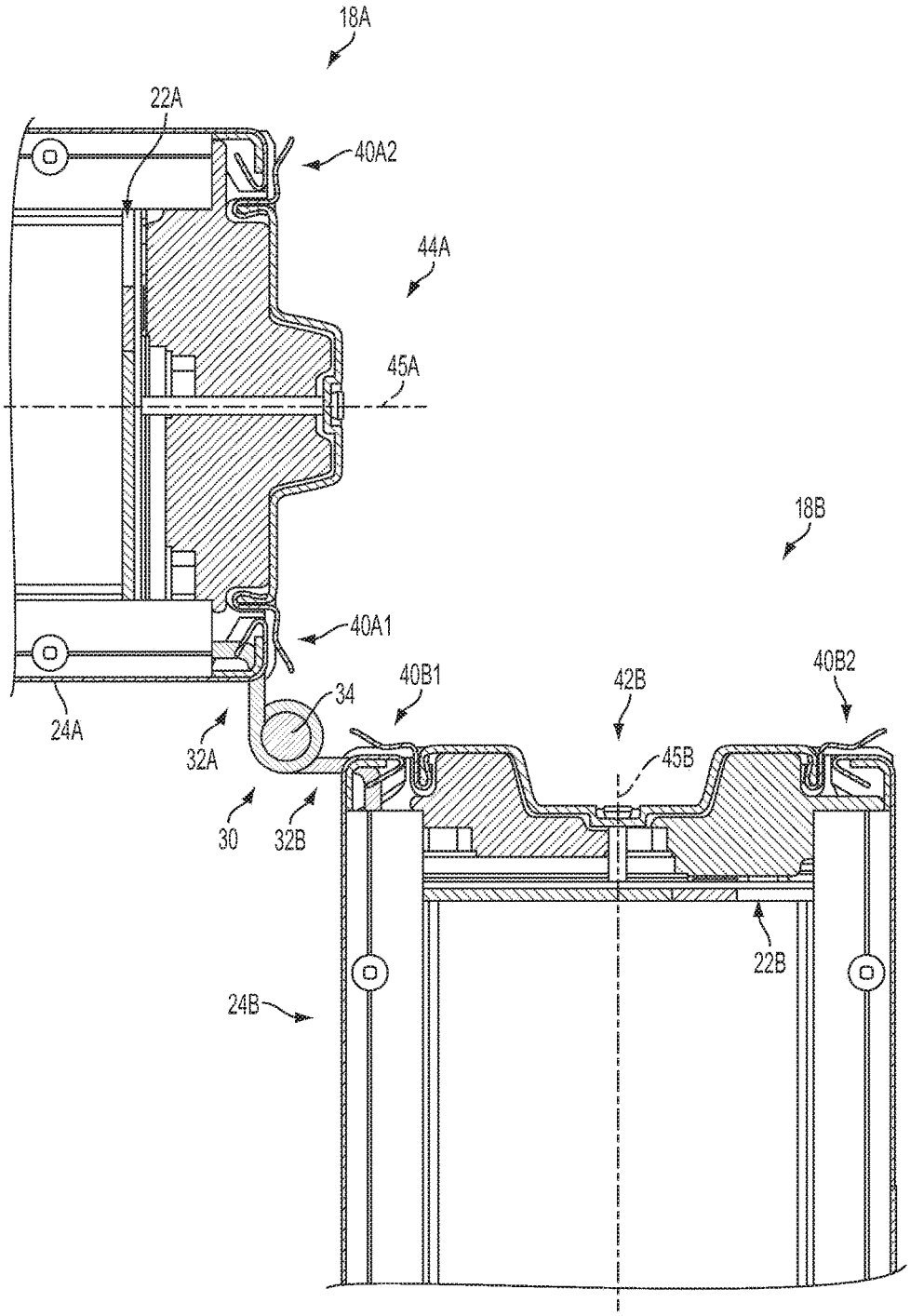
FIG. 3 illustrates a horizontal sectional view of portions of a pair of exemplary paired panels of the paired panel partition of FIG. 1 illustrating the attachment of a hinge to each of a first moveable panel and a second moveable panel, each of the first moveable panel and the second moveable panel including seals which cooperate to seal a gap between the first moveable panel and the second moveable panel.

Referring to FIG. 3, a pair of panels 18A and 18B are illustrated which are coupled together by a hinge 30. Although, a single hinge 30 is shown, multiple hinges 30 may be provided along the length of the panels 18A and 18B, such as shown in FIG. 2. Hinges 30 includes a first hinge portion 32A coupled to panel 18A and a second hinge portion 32B coupled to panel 18B. Hinge portions 32A and 32B pivot relative to each other about axis 34 of hinge 30.

When hinge portion 32A rotates (clockwise based on the arrangement shown in FIG. 3) towards hinge portion 32B, a second end 44A of panel 18A rotates towards a first end 42B of panel 18B. In one embodiment, panels 18A and 18B are suspended from an overhead track 12 and both of first hinge portion 32A and second hinge portion 32B rotate towards each other.

As shown in FIG. 3, second end 44A and first end 42B include complementary features which engage to further couple panel 18A and panel 18B together when panel face 24A of panel 18A is generally coplanar with panel face 24B of panel 18B. Even though the complementary features of second end 44A of panel 18A and first end 42B of panel 18B engage together, a gap still exists between the panel 18A and panel 18B. As explained herein, panels 18A and 18B support seals to seal this gap between the panel 18A and panel 18B when the panel face 24A of panel 18A is generally coplanar with panel face 24B of panel 18B.

Panel 18A supports a pair of seals 40A1 and 40A2 which extend generally from the top of panel 18A to the bottom of panel 18A (see FIG. 2). Panel 18B supports a pair of seals 40B1 and 40B2 which extend generally from the top of panel 18B to the bottom of panel 18B (see FIG. 2). Seals 40 provide an acoustical seal between panel 18A and panel 18B. By having seals 40 run vertically the entire height of panels 18A and 18B without being cut out for hinges 30, increased acoustic blocking at the face of the panels may be obtained.

Figure 4:
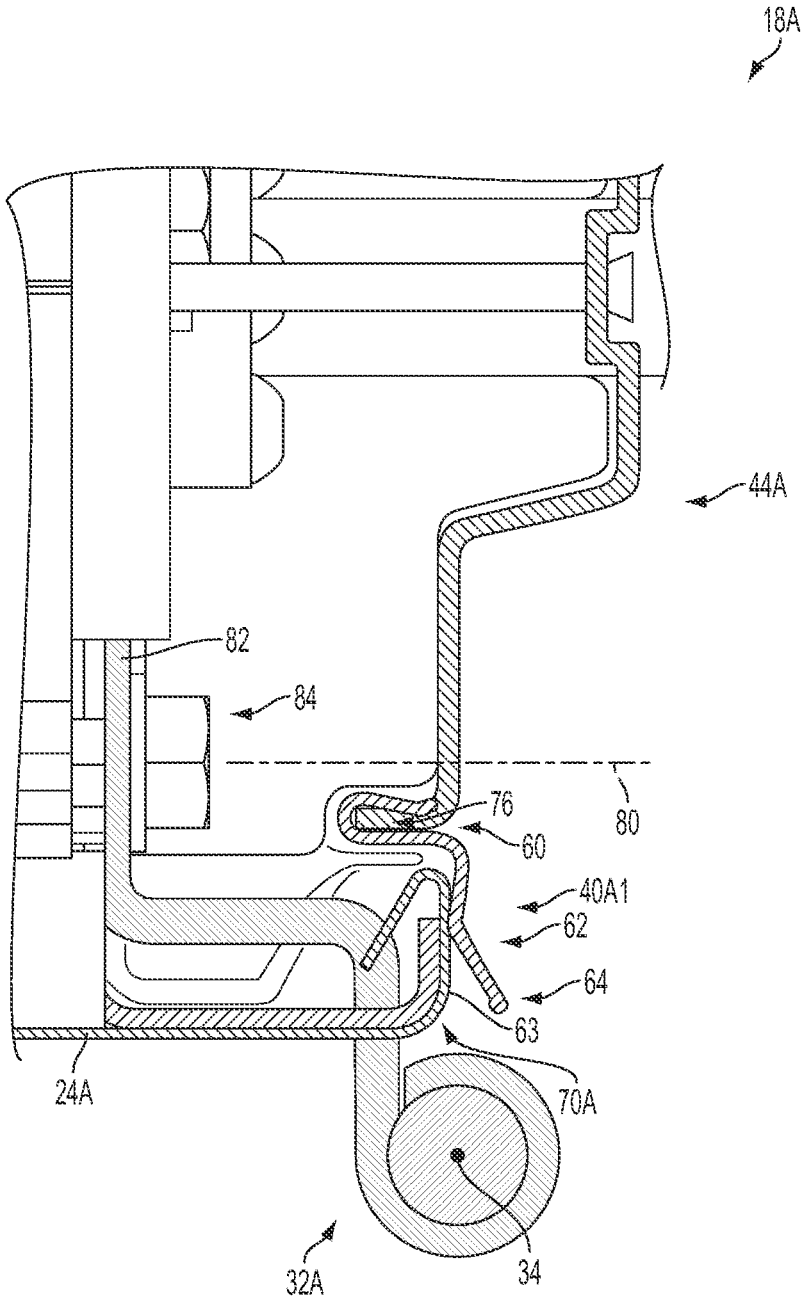
FIG. 4 illustrates a portion of one of the exemplary moveable panels of FIG. 3 illustrating the attachment of the hinge to the exemplary moveable panel.

Referring to FIG. 4, seal 40A1 of panel 18A is shown positioned relative to panel 18A and first hinge portion 32A. As shown in FIG. 4, seal 40A1 includes a first portion 60 coupled to second end 44A of panel 18A and a second portion 62 which extends from surface 63 of second end 44A. In the illustrated embodiment, first portion 60 is coupled to an ear 76 of panel 18A due to the clamping force of first portion 60 on ear 76. In one embodiment, first portion 60 and second portion 62 are made of the same material, but have differing durometers. In one example, first portion 60 is harder than second portion 62. In one embodiment, the durometer of portion 62 is A65 and the durometer of the first portion 60 is D80. Other suitable durometer materials may be used. Second portion 62 includes a first end 64. When panel face 24A of panel 18A is coplanar with panel face 24B (see FIG. 3) of panel 18B, second portion 62 contacts the corresponding second portion 62 of seal 40B1 (see FIG. 3) and is generally moved towards surface 63 of panel 18A. In one embodiment, when panel face 24A of panel 18A is coplanar with panel face 24B of panel 18B, first end 64 is generally positioned at a first corner 70A of panel 18A at the intersection of panel face 24A and second end 44A. In one embodiment, when panel face 24A of panel 18A is coplanar with panel face 24B of panel 18B, first end 64 is generally positioned at a first corner 70A of panel 18A at the intersection of panel face 24A and second end 44A and contacts the end 64 of the seal 40B1 of the adjacent panel.

In the illustrated embodiment, seal 40A1 is generally positioned at the panel face 24A of panel 18A when panel face 24A of panel 18A is coplanar with panel face 24B of panel 18B. Since seal 40A1 is positioned behind the portion of first hinge portion 32A extending from panel 18A, the first end 64 of seal 40A1 may be continuous from the top of panel 18A to the bottom of panel 18A.

A portion 82 of first hinge portion 32A is coupled to panel 18A with a fastener 84 to provide a rigid coupling between first hinge portion 32A and panel 18A. As shown in FIG. 4, portion 82 is coupled to fastener 84 generally along plane 80 which is positioned rearward of and parallel to panel face 24A of panel 18A. In the illustrated embodiment, seal 40A1 is positioned completely forward of plane 80. In one embodiment, second portion 62 of seal 40A1 is positioned completely forward of plane 80 while at least a portion of seal 40A1 is positioned rearward of plane 80. In one embodiment, first end 64 is positioned forward of plane 80.

The moveable wall panel 18A and the moveable wall panel 18B each includes a mid-plane 45A and 45B, respectively, which is parallel to the panel face 24A and 24B, respectively. The respective the seals 40A1 and 40B1, hinge portions 32A and 32B, and panel faces 24A and 24B are all located on a first side of the mid-plane.

Figure 5:
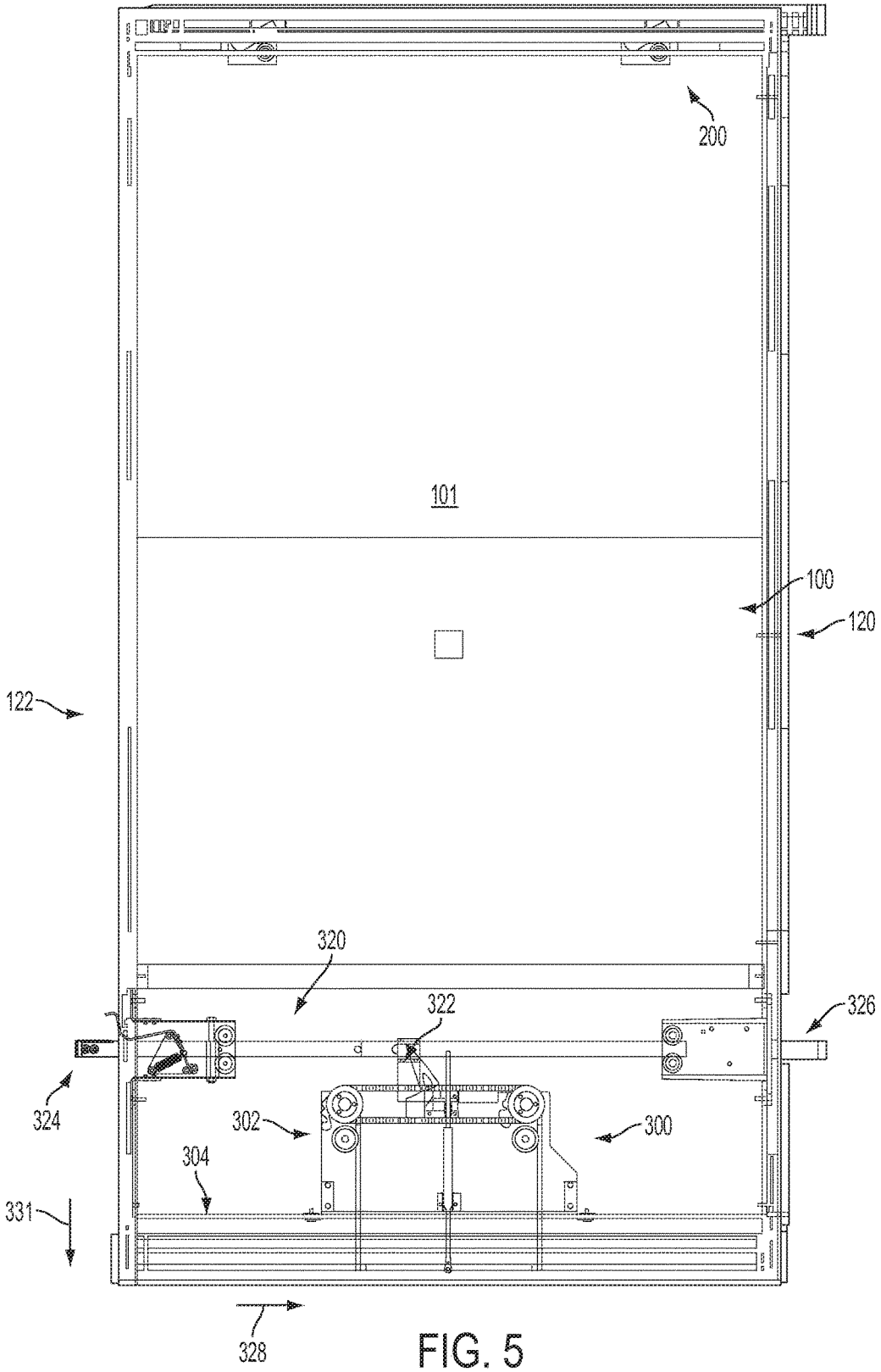
FIG. 5 illustrates an exemplary panel for inclusion in a moveable wall system, the exemplary panel including a top automatic seal and a bottom automatic seal, each being engaged with the respective ceiling and floor automatically when the exemplary panel is put into place.

Referring to FIG. 5, another exemplary panel 100 is shown. In one embodiment, panel 100 includes the features of panel 18 discussed herein. Panel 100 may be suspended from an overhead track 12.

Figure 5A:
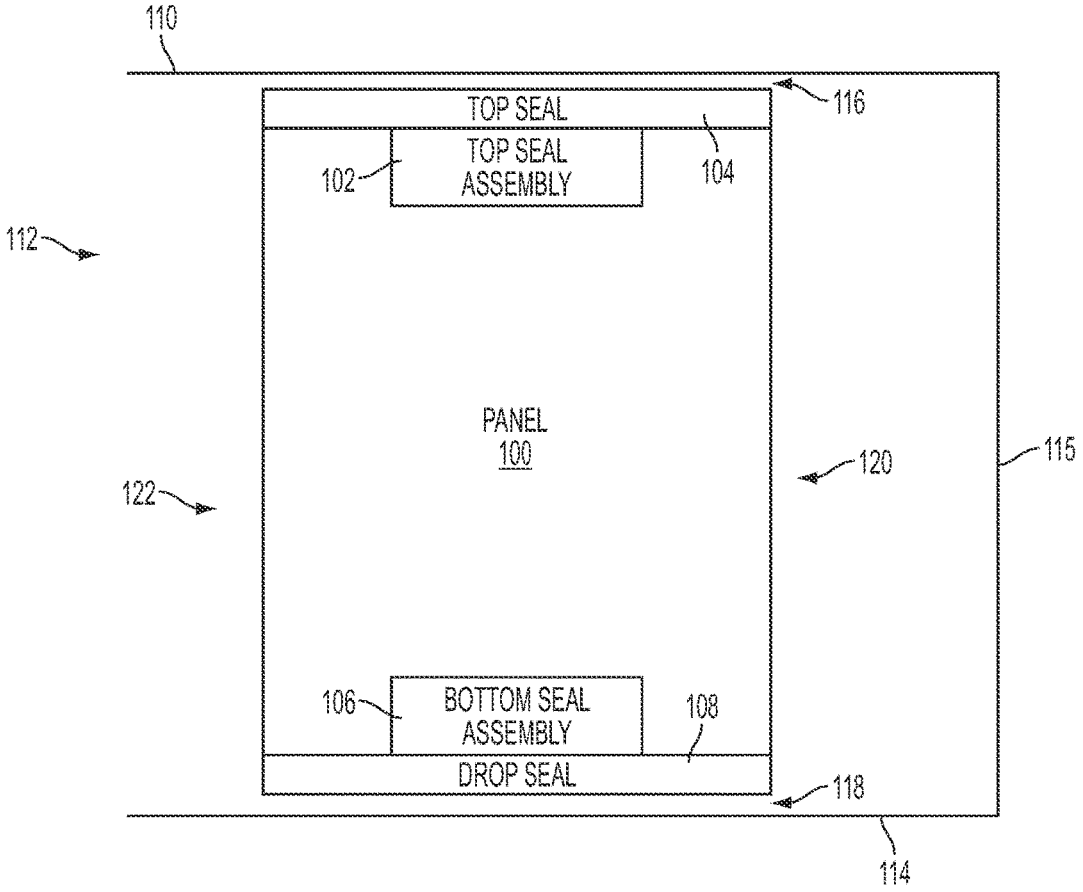
FIG. 5A illustrates an exemplary panel having a top seal and a bottom seal in an unsealed position relative to a ceiling and a floor of an environment, respectively.
Figure 5B:
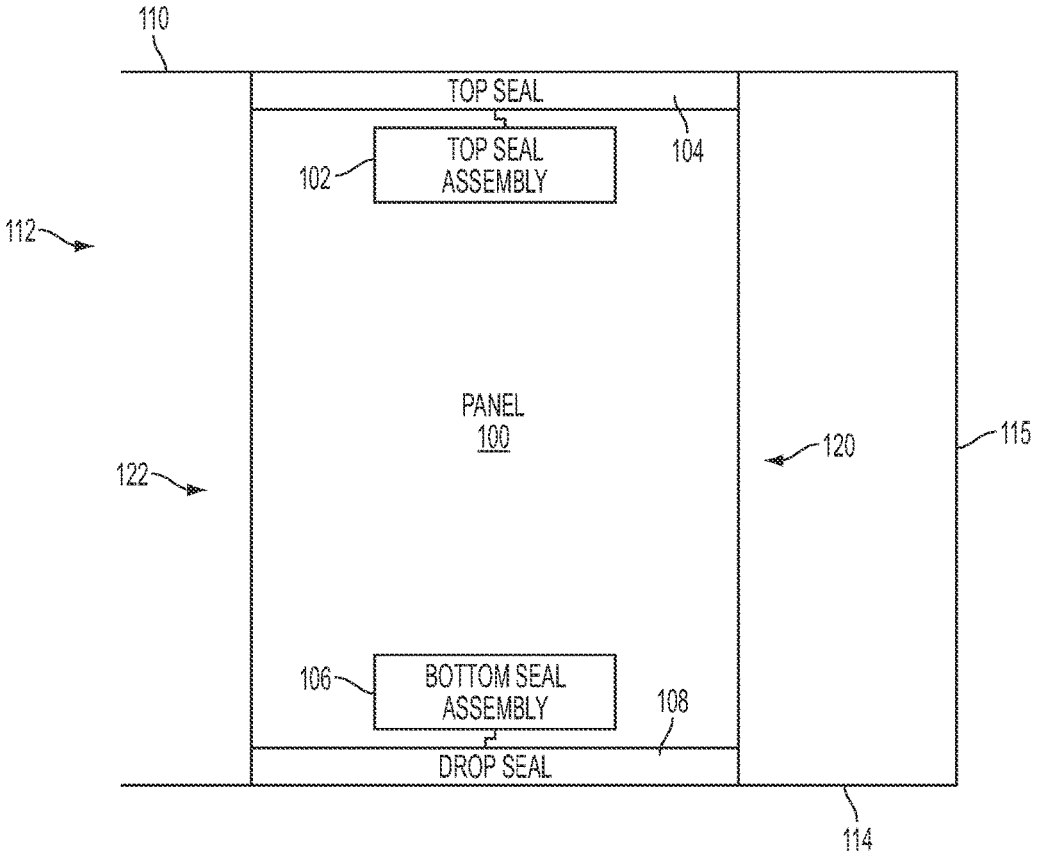
FIG. 5B illustrates the exemplary panel of FIG. 5A having the top seal and the bottom seal in an sealed position relative to a ceiling and a floor of an environment, respectively.
Figure 6:
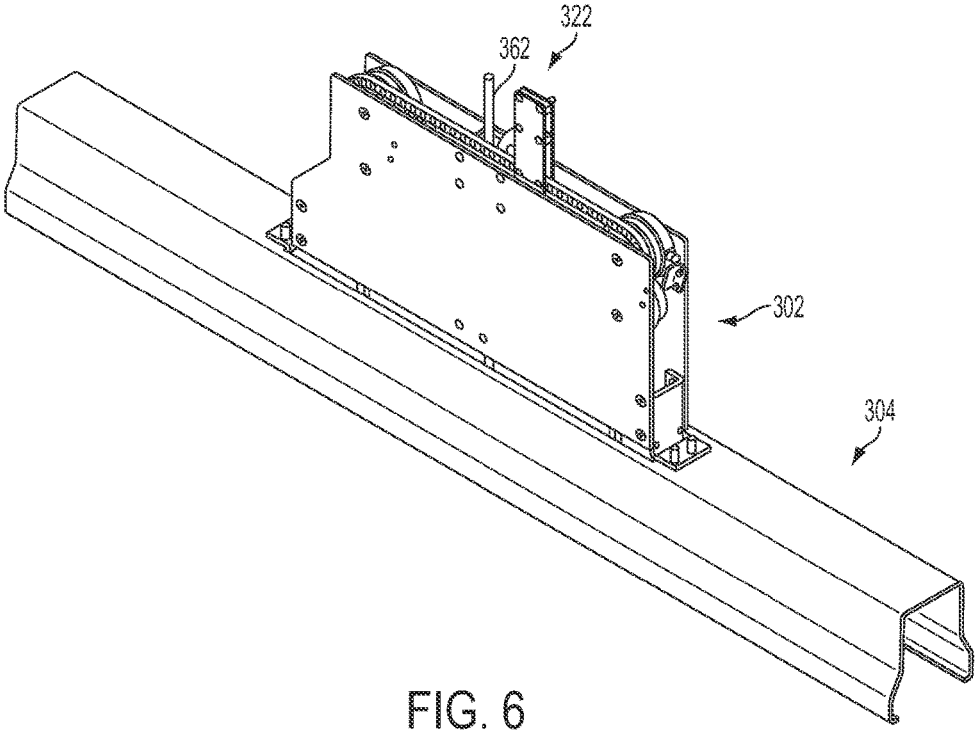
FIG. 6 illustrates an isometric view of a lower frame of the exemplary panel of FIG. 5 and an exemplary seal drop assembly.

Referring to FIGS. 5A and 5B, panel 100 is shown having a top seal assembly 102 and a bottom seal assembly 106. Top seal assembly 102 positions a top seal 104 carried by the panel 100 relative to a ceiling 110 of an environment 112, such as a room. In one embodiment, top seal assembly 102 is a manually actuated top seal assembly whereby an operator through an actuation assembly cranks or otherwise actuates an input on panel 100 to raise or lower top seal 104 relative to ceiling 110 of environment 112. In one embodiment, top seal assembly 102 is an automatic top seal assembly, such as automatic top seal assembly 200 (see FIG. 5 and FIGS. 15-20), which automatically moves top seal 104 relative to ceiling 110 based on a position of panel 100. As explained in connection with FIGS. 15-17, in one embodiment when a leading end 120 of panel 100 contacts a stop surface, such as a wall 115 of environment 112 or a trailing end 122 of an adjacent panel 100, the top seal 104 is brought into contact with the ceiling 110.

Bottom seal assembly 106 positions a drop seal 108 carried by the panel 100 relative to a floor 114 of environment 112, such as a room. In one embodiment, bottom seal assembly 106 is a manually actuated assembly whereby an operator through an actuation assembly cranks or otherwise actuates an input on panel 100 to raise or lower seal 108 relative to floor 114 of environment 112. An exemplary manually actuated assembly 400 is shown in FIGS. 21-29. In one embodiment, bottom seal assembly 106 is an automatic bottom seal assembly, such as automatic bottom seal assembly 300 (see FIGS. 5-14), which automatically moves drop seal 108 relative to floor 114 based on a position of panel 100. As explained in connection with FIGS. 5-14, in one embodiment when a leading end 120 of an adjacent panel 100 contacts an actuator accessible at the trailing edge of the panel 100, the automatic bottom seal assembly is moved to place the seal 108 in the sealed position relative to the floor 114.

When suspended from an overhead track 12, panel 100 has a clearance distance 116 (see FIG. 5A) from ceiling 110 of environment 112 and a clearance distance 118 (see FIG. 5A) from floor 114 of environment 112. Referring to FIG. 5B, top seal 104 provides an acoustical seal between ceiling 110 and panel 100 when the panel 100 is positioned in the desired location (see FIG. 5B) and drop seal 108 provides an acoustical seal between floor 114 and panel 100 when the panel 100 is positioned in the desired location (see FIG. 5B).

Figure 7:
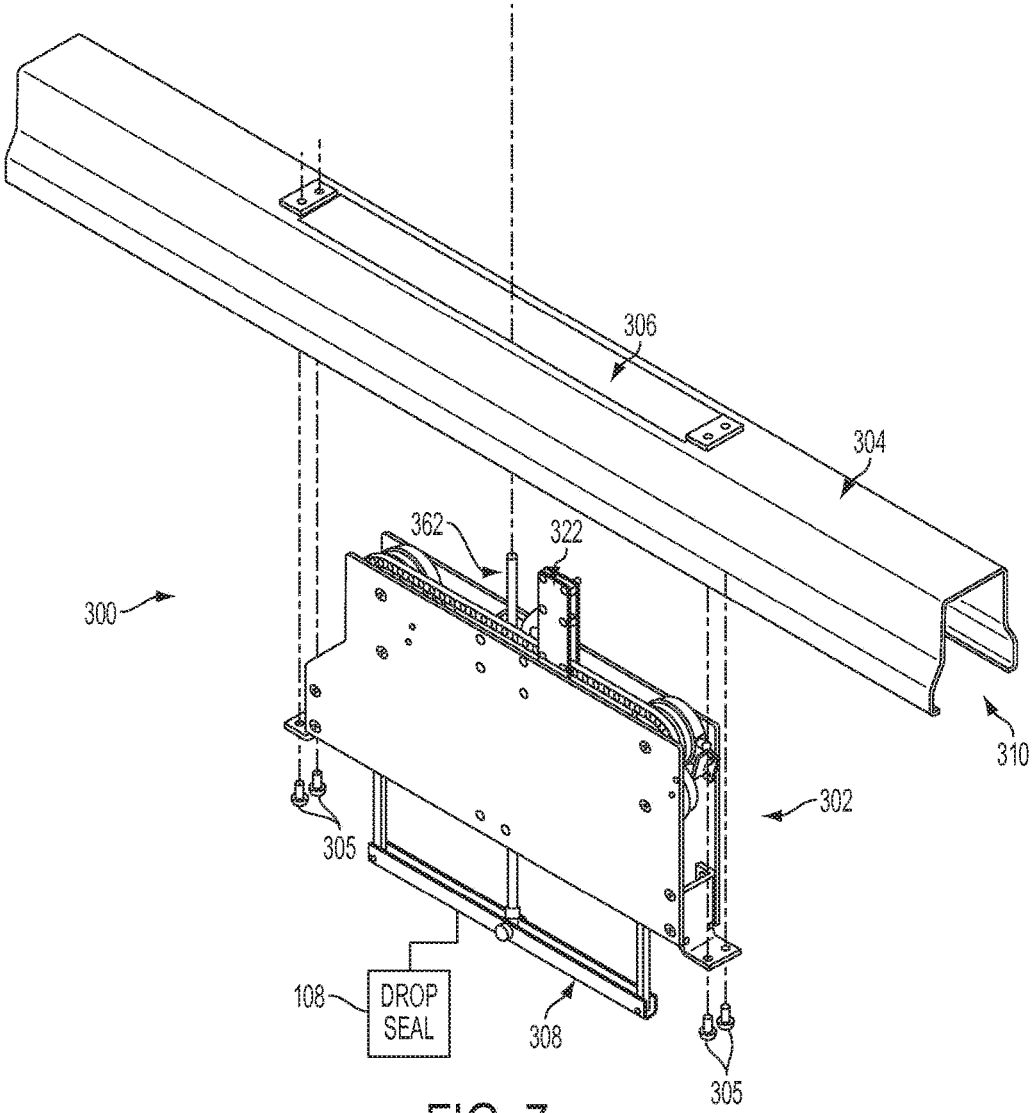
FIG. 7 illustrates the view of FIG. 6 with the seal drop assembly exploded from the lower frame.
Figure 8:
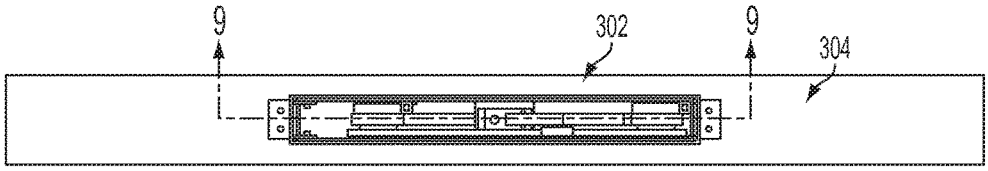
FIG. 8 illustrates a top view of the assembly of FIG. 6.

Referring to FIGS. 6-14, an exemplary automatic bottom seal assembly 300 is shown. Referring to FIG. 7, automatic bottom seal assembly 300 includes a bottom drop seal assembly 302 which is coupled to drop seal 108. Bottom drop seal assembly 302 is further coupled to a drop seal frame 304 of the frame of panel 100. Bottom drop seal assembly 302 is coupled to drop seal frame 304 through a plurality of fasteners 305 and extends upward through an opening 306 in drop seal frame 304. A lower elongated member 308 is coupled to drop seal 108. When drop seal 108 is positioned in the unsealed position, drop seal 108 is generally received in a channel 310 of drop seal frame 304. As shown in FIG. 5, bottom drop seal assembly 302 and drop seal frame 304 are generally housed within panel 100 behind a panel face 101 of panel 100. Exemplary drop seals include the Series SM available from Modernfold, Inc. located at 215 W New Rd in Greenfield, Ind. 46140.

Figure 12:
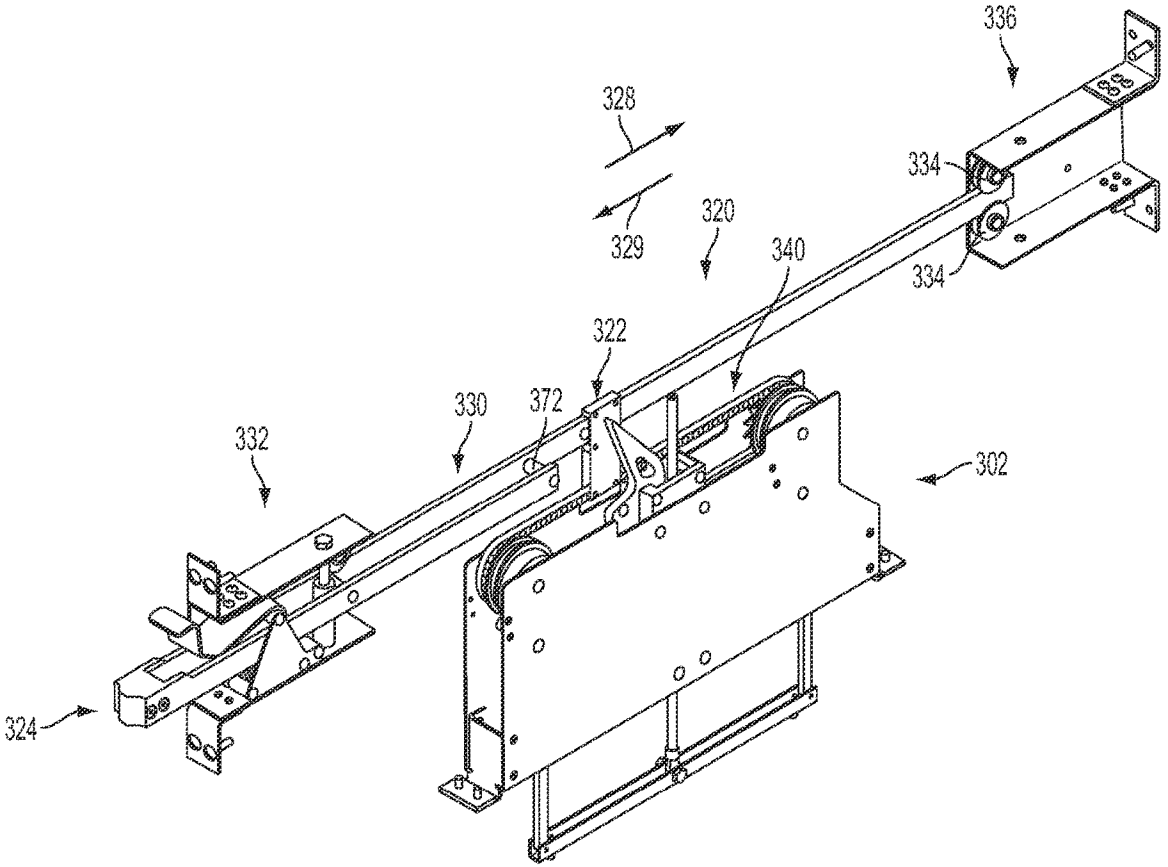
FIG. 12 illustrates an isometric view of the seal drop assembly of FIG. 6 coupled to an actuator assembly.

Referring to FIG. 12, bottom drop seal assembly 302 is coupled to an actuator assembly 320 through a bracket 322. Returning to FIG. 5, actuator assembly 320 includes an actuator input 324 which extends beyond trailing end 122 of panel 100. Panel 100 also includes an actuator 326 which extends beyond leading end 120 of panel 100. The actuator 326 is configured to move actuator input 324 in direction 328 when actuator 326 contacts actuator input 324. It should be understood that actuator 326 of an adjacent panel 100 (to the left) contacts actuator input 324 of the illustrated panel 100. In a similar fashion actuator 326 of the illustrated panel contacts an actuator input 324 of an adjacent panel 100 (to the right). As explained herein by moving actuator input 324 in direction 328, bottom drop seal assembly 302 moves drop seal 108 in direction 331 towards the floor 114 (see FIG. 5).

As shown in FIG. 12, actuator 324 is coupled to an elongated rail 330. Rail 330 is supported proximate trailing end 122 of panel 100 by a latch assembly 332 having a plurality of rollers 334 (see FIG. 13) which guide rail 330 and is supported proximate leading end 120 by a guide assembly 336 having a plurality of rollers 334 which guide rail 330.

Figure 9:
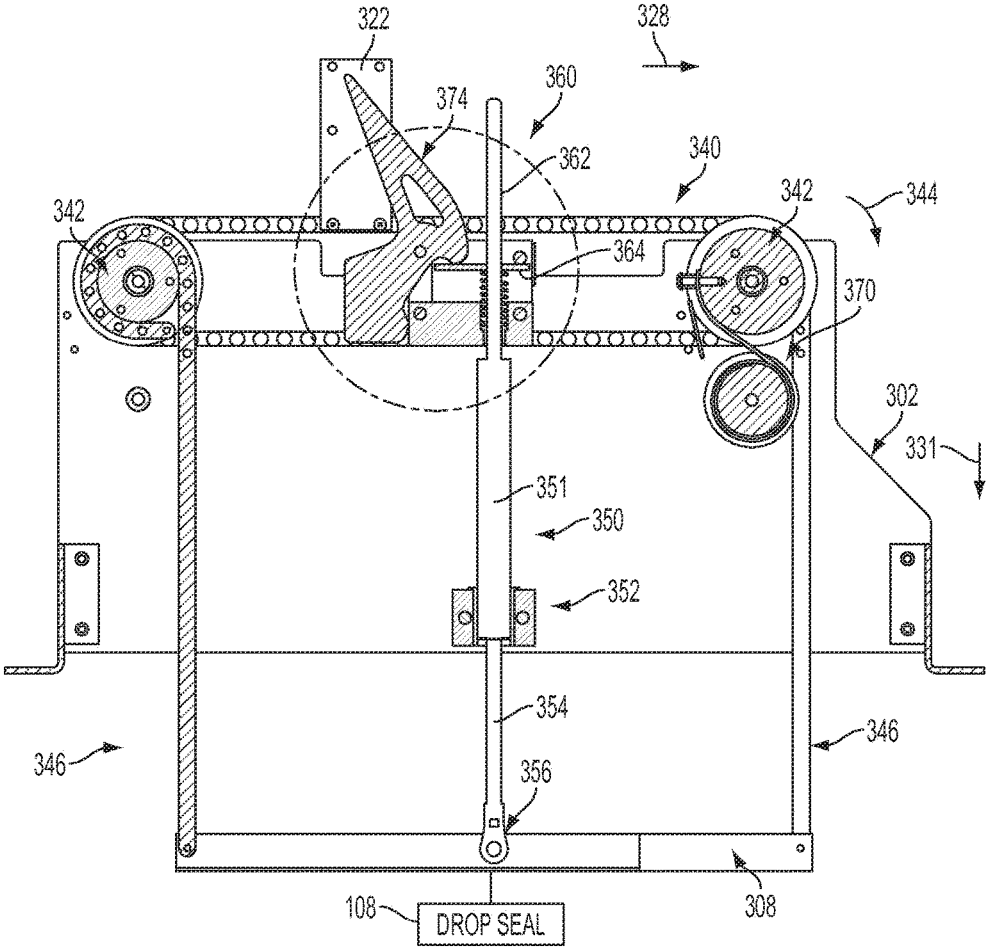
FIG. 9 illustrates a partial sectional view of the seal drop assembly of FIG. 6 along lines 9-9 in FIG. 8, the seal drop assembly including a damper, illustratively a gas spring, the gas spring not shown in section to simplify the illustration.

Referring to FIG. 9, bracket 322 is coupled to rail 330 and is moveable with rail 330 in direction 328 and direction 329. Bracket 322 is coupled to a endless track 340 of bottom drop seal assembly 302. An exemplary endless track is a linked chain. Referring to FIG. 9, endless track 340 engages two rotatable members 342 which rotate based on the movement of endless track 340. Exemplary rotatable members are sprockets. As bracket 322 is moved in direction 328, endless track 340 also moves causing rotatable members 342 to rotate in direction 344. Bracket 322 is coupled to a top portion of endless track 340. The rotation of rotatable members 342 in direction 344 causes supports 346 to be lowered in direction 331. In the illustrated embodiment, supports 346 are chains which are wound over rotatable members 342.

The lowering of supports 346 permits lower elongated member 308 to lower in direction 331 due to its connection to supports 346. This permits drop seal 108 to approach and contact floor 114 of environment 112. As lower elongated member 308 is lowered in direction 331, a gas spring 350 is also lowered in direction 331. As shown in FIG. 9, the cylinder 351 of gas spring 350 moves up and down in an opening in a bracket 352. A rod 354 of gas spring 350 is coupled to lower elongated member 308 through a coupler 356 threaded onto the end of rod 354. Lower elongated member 308 is able to pivot relative to gas spring 350 while gas spring 350 remains generally vertical. This pivoting movement may accommodate an unlevel floor 114.

A second coupler 360 is coupled to a rear portion of cylinder 351 of gas spring 350. Second coupler 360 is an elongated rod 362 which passes through an opening in a lock plate 364. In the arrangement shown in FIG. 9, elongated rod 362 may freely move through the opening in lock plate 364.

The rotation of rotatable members 342 in direction 344 is resisted by springs 370 (one shown in FIG. 9) which bias the rotatable members 342 to rotate back in the opposite direction of direction 344. This biasing assists in raising drop seal 108 relative to floor 114.

Figure 10:
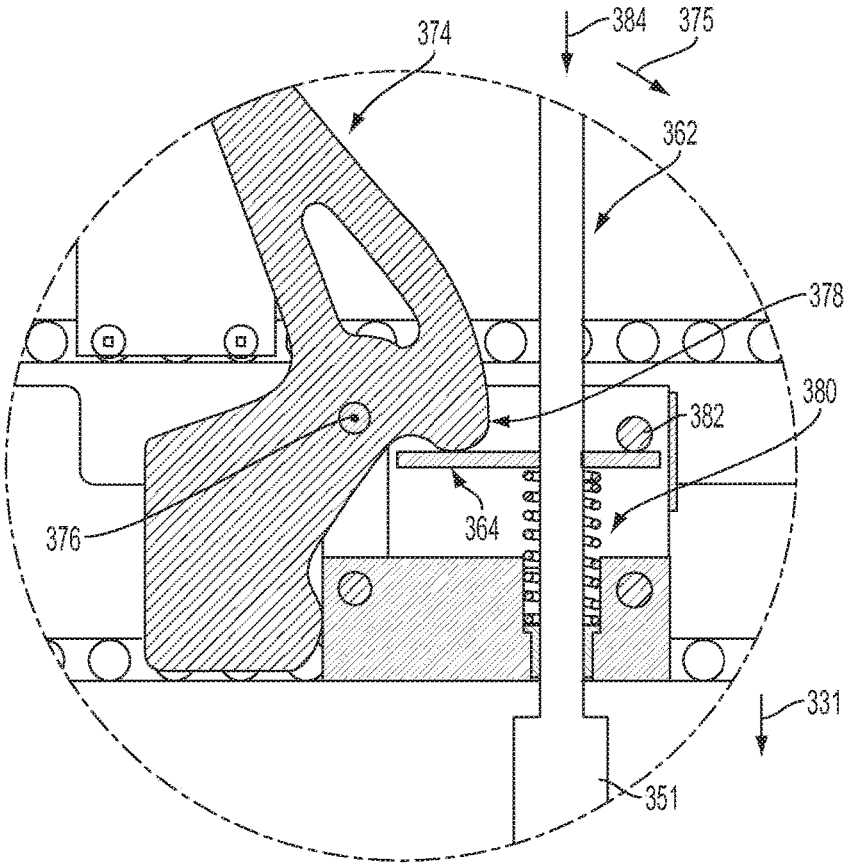
FIG. 10 illustrates a detail view of FIG. 9.
Figure 11:
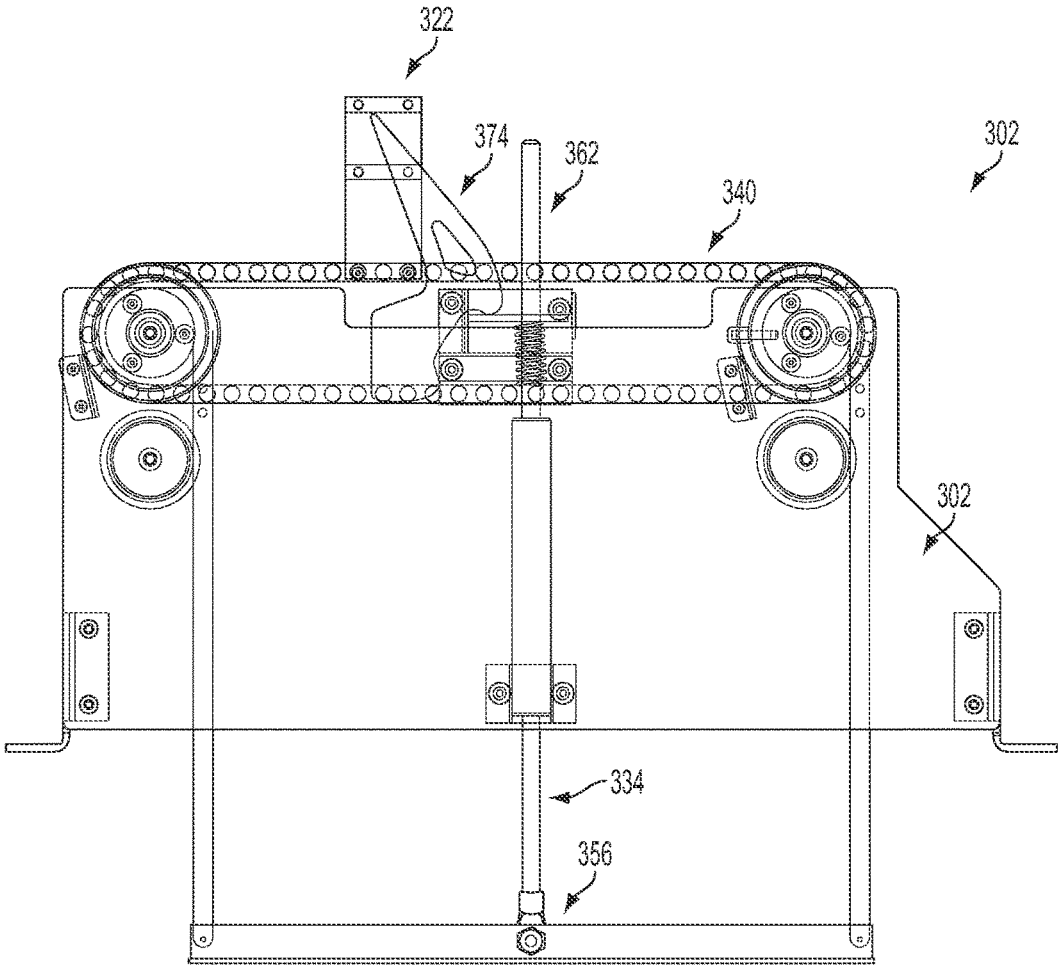
FIG. 11 illustrates a front view of the seal drop assembly of FIG. 6.

Returning to FIG. 12, rail 330 includes a pin 372 which contacts a lever 374 of bottom drop seal assembly 302 once drop seal 108 has been dropped by the movement of bracket 322. Referring to FIG. 10, the continued movement of rail 330 in direction 328 causes the pin to engage lever 374 which causes lever 374 to rotate clockwise in direction 375 about a pivot axis 376 of lever 374. This rotation of lever 374 causes a portion 378 of lever 374 to push down on lock plate 364. This downward force on lock plate 364 is countered by an upward force exerted on lock plate 364 by a spring 380. Due to the downward force on lock plate 364 being off-center relative to upward force of lock plate 364 exerted by spring 380, lock plate 364 rotates counterclockwise. This counterclockwise rotation of lock plate 364 causes the opening in lock plate 364 to be reduced when viewed from direction 384. This effective reduction in the opening size causes lock plate 364 to lock onto to rod 362. Further downward force exerted on lock plate 364 by lever 374 causes the lock plate 364 and elongated rod 362 to move downward in direction 331. Since the drop seal 108 is currently contacting the floor 114 or soon will, this downward movement causes the gas spring 350 to be compressed once drop seal 108 contacts the floor 114. The compression of gas spring 350, results in the force being applied by drop seal 108 against floor 114 to be increased due to the nature of gas spring 350 wanting to expand back out. Further downward movement does not result in a further increase in the force being applied by drop seal 108 against floor 114, but rather the force is maintained generally constant due to gas spring 350. As such, bottom drop seal assembly 302 is able to provide a constant force between drop seal 108 and floor 114 for a range of installations having differing clearance distance 118 between drop seal 108 and floor 114.

Figure 13:
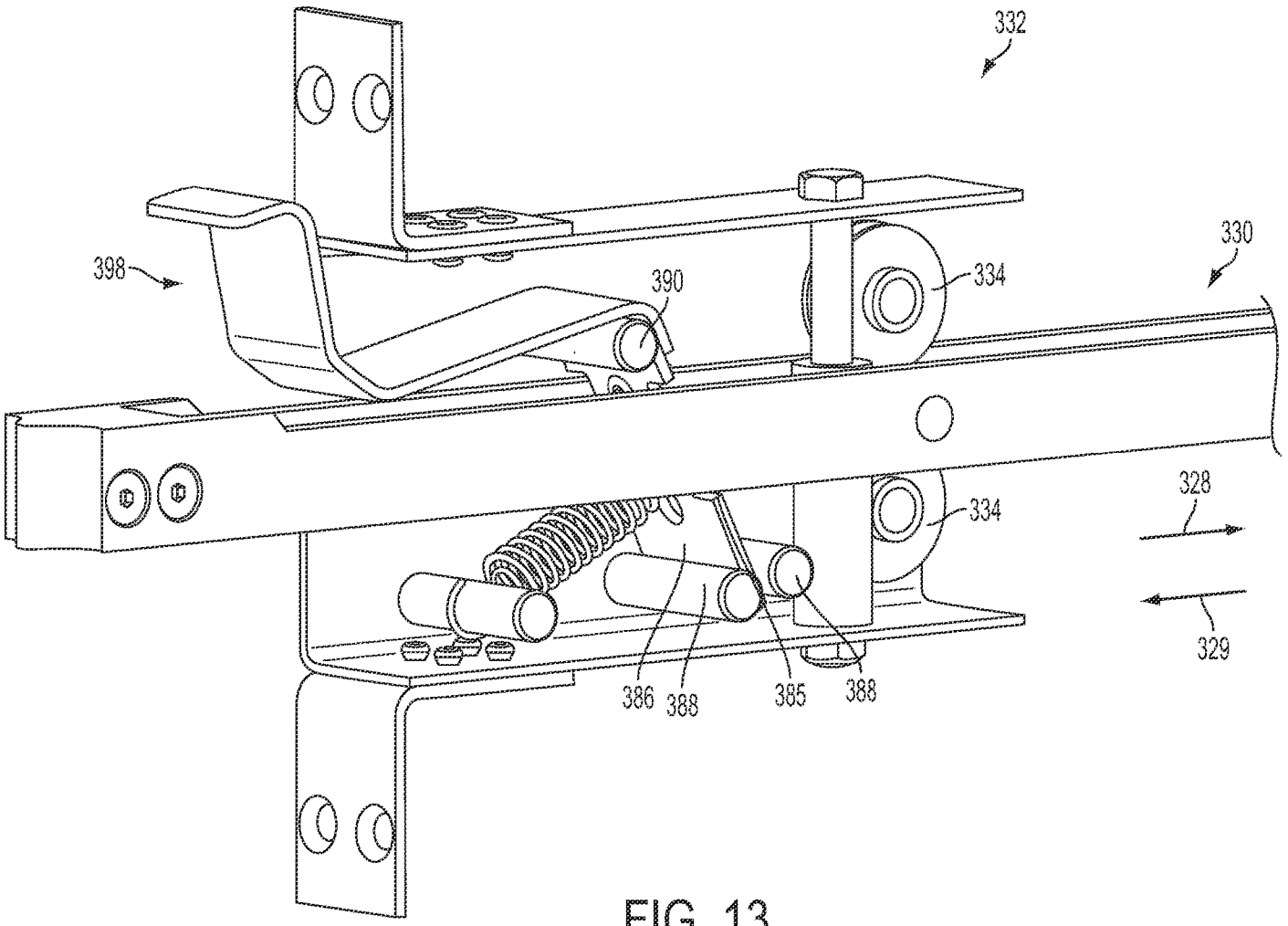
FIG. 13 illustrates a portion of a latch assembly of the actuator assembly of FIG. 12.
Figure 14:
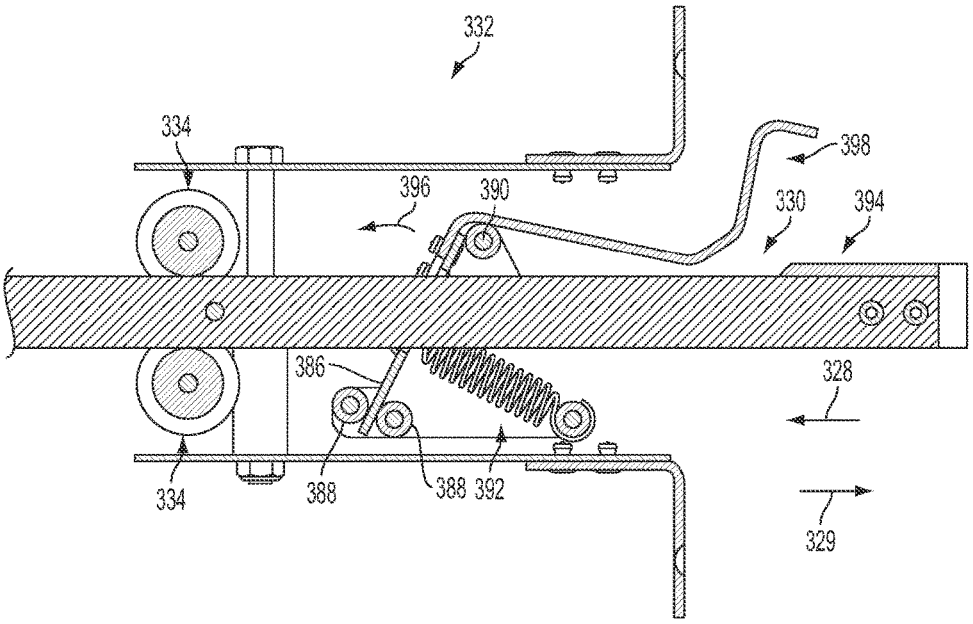
FIG. 14 illustrates a sectional view of the latch assembly of the actuator assembly of FIG. 12.

Referring to FIG. 13, rail 330 is held in place when drop seal 108 is sealed against floor 114 and prevented from movement in direction 329 due to latch assembly 332. Latch assembly 332 includes a latch plate 386 having an opening 385 through which elongated rail 330 passes. Latch plate 386 is held in place by two pins 388 and 390 and a spring 392.

As elongated rail 330 continues to move in direction 328, a raised portion 394 of elongated rail 330 passes into opening 385 of latch plate 386. This causes latch plate 386 to rotate in direction 396 against the bias of spring 392. In addition, the presence of raised portion 394 in opening 385 reduces the clearance between elongated rail 330 and latch plate 386. The spring 392 attempts to rotate latch plate 386 back in the opposite direction of direction 396 thereby locking latch plate 386 onto elongated rail 330. This prevents the movement of elongated rail 330 in direction 329.

To permit the movement of elongated rail 330 in direction 329, a latch 398 is raised which causes latch plate 386 to rotate in direction 396 against the bias of spring 392 thereby providing clearance between elongated rail 330 and latch plate 386.

Bottom drop seal assembly 302 by way of gas spring 350 provides a generally constant seal force with drop seal 108 against floor 114. Further, the seal force is greater than input force of the actuator assembly. In one embodiment, for a 50 pound input force, a seal force of about 120 pounds is achieved. In one embodiment, gas spring 350 compresses about ⅜ of an inch.

Figure 15:
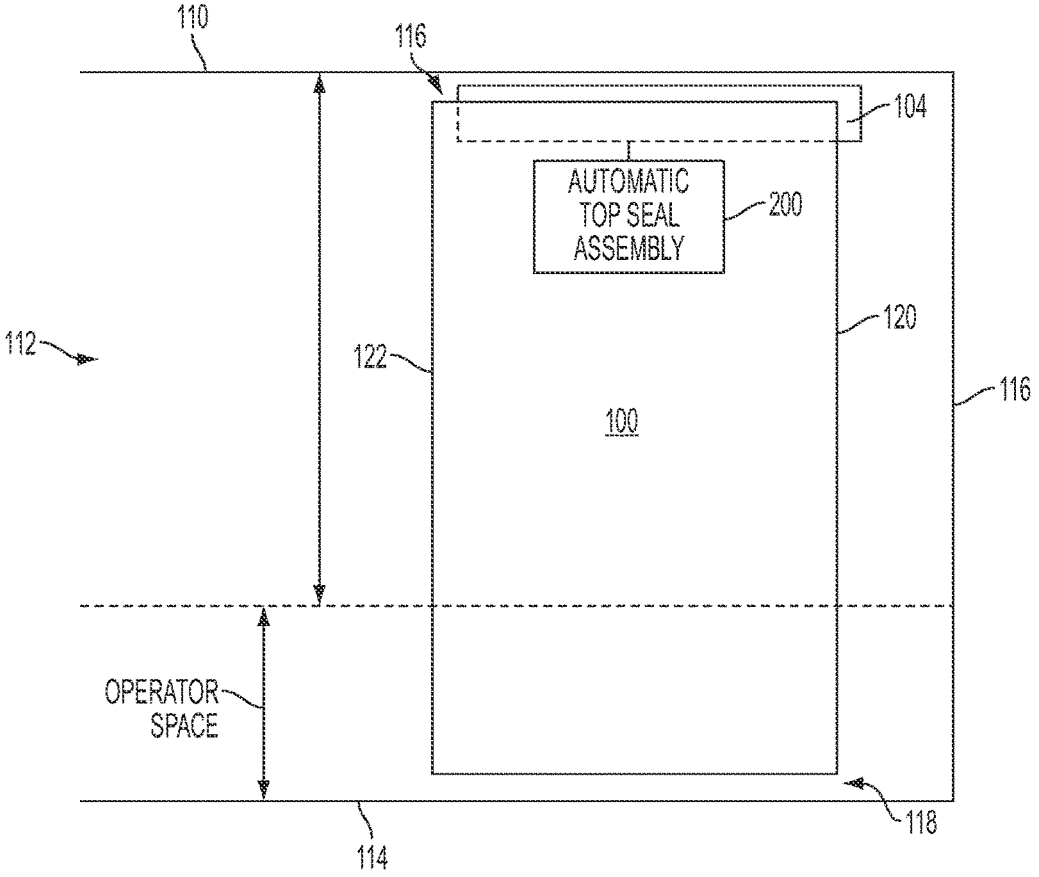
FIG. 15 illustrates an exemplary panel including a top automatic seal positioned above an operator space and being placed in sealing relationship with a ceiling of the environment without an actuation of an actuator in the operator space.
Figure 16:
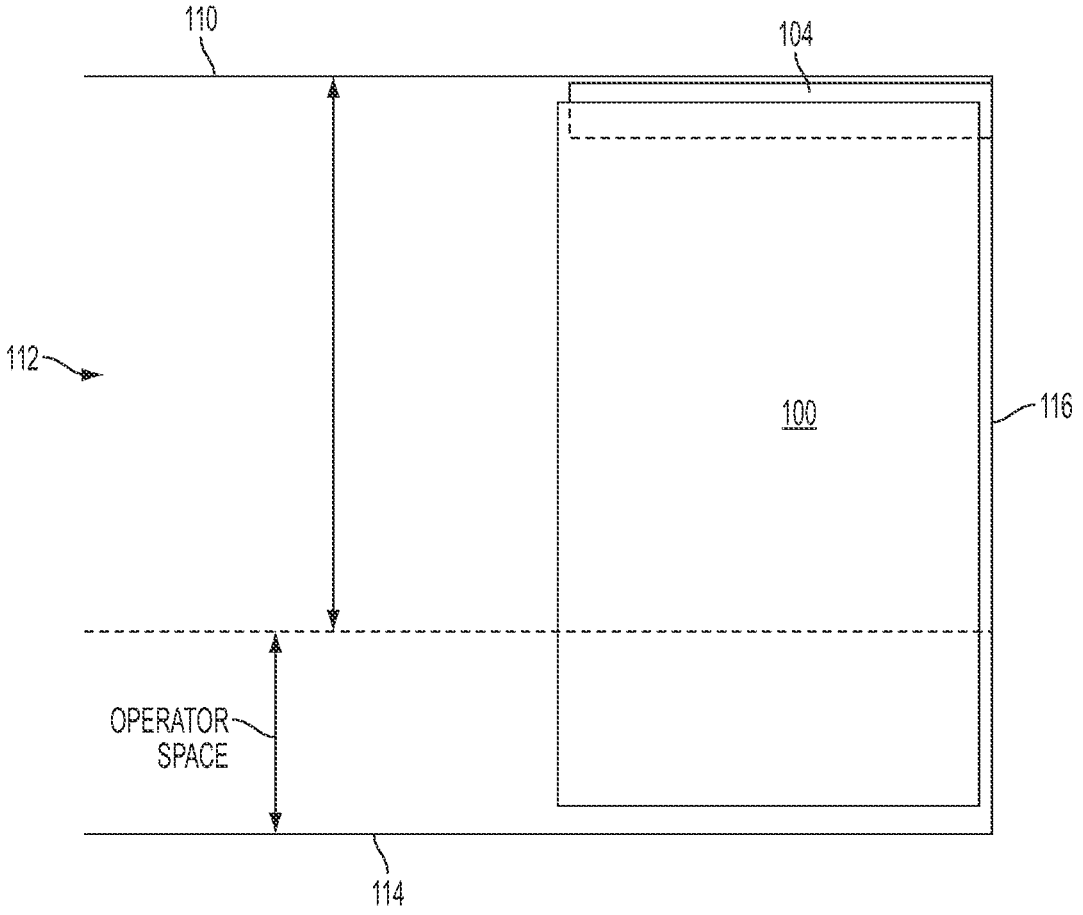
FIG. 16 illustrates the exemplary panel of FIG. 15 wherein a leading edge of the upper seal is engaged with a vertical structure of the environment, such as a wall or adjacent panel, and the top automatic seal has closed the space between the seal and the ceiling.
Figure 17:
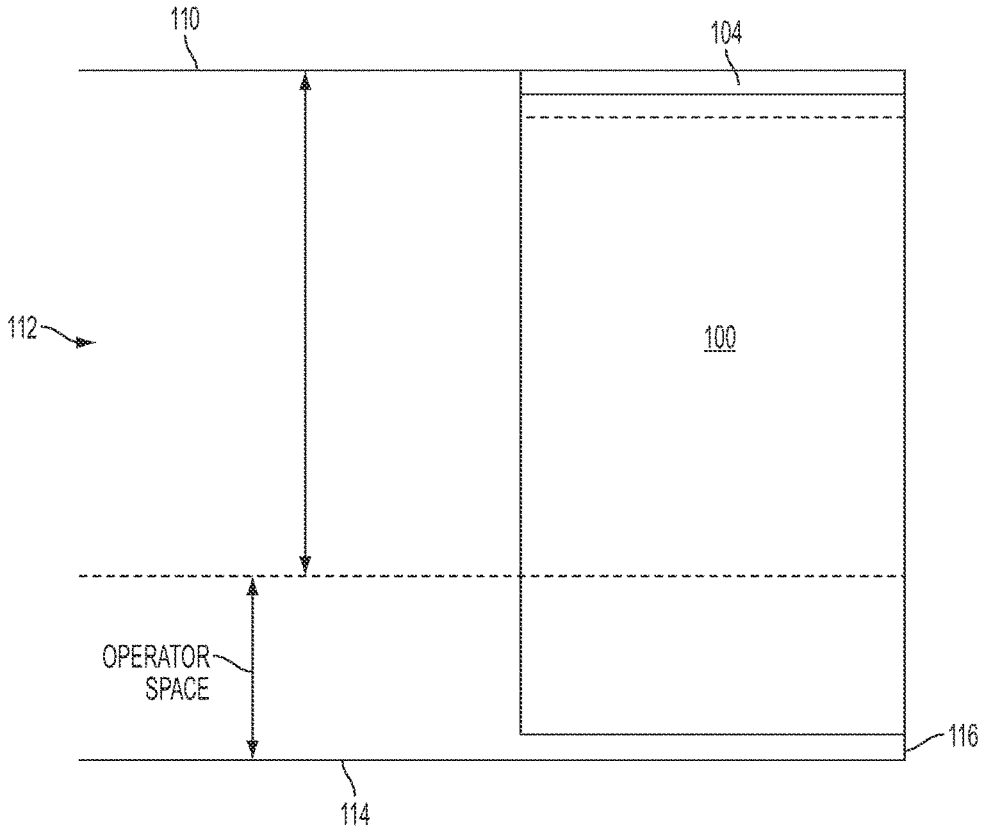
FIG. 17 illustrates the exemplary panel of FIG. 16 with the seal of the top automatic seal sealed against the ceiling.

Referring to FIGS. 15-17, the movement of top seal 104 by automatic top seal assembly 200 is illustrated as panel 100 is moved into contact with wall 116 of environment 112. As shown in FIG. 15, top seal 104 has a clearance distance 116 from ceiling 110 of environment 112. A portion of top seal 104 extends beyond leading end 120 of panel 100. This portion contacts wall 116 and due to automatic top seal assembly 200 is moved leftward towards trailing end 122 and upwards towards ceiling 110 thereby reducing the gap 116 between top seal 104 and ceiling 110. Once leading end 120 of panel 100 is against wall 116 (or the trailing end 122 of an adjacent panel 100), top seal 104 is generally in line with panel 100 and seals the gap between top seal 104 and ceiling 110.

Automatic top seal assembly 200 automatically positions top seal 104 in a sealed position with ceiling 110 without the need of an actuation from an operator in an operator space of environment 112. An exemplary operator space extends from a floor 114 of environment 112 up to a height of 4 to 6 feet. It is within this space that in prior art systems, an operator could actuate a crank which would be coupled to a top seal to raise the top seal. However, panel 100 may be anywhere from 8 feet tall to 85 feet tall. Automatic top seal assembly 200 advantageously is able to position top seal 104 without the need for an actuator spanning a distance from the operator space up to the top seal 104. Further, automatic top seal assembly 200 is operable independent of its distance above the operator space of environment 112.

Figure 18:
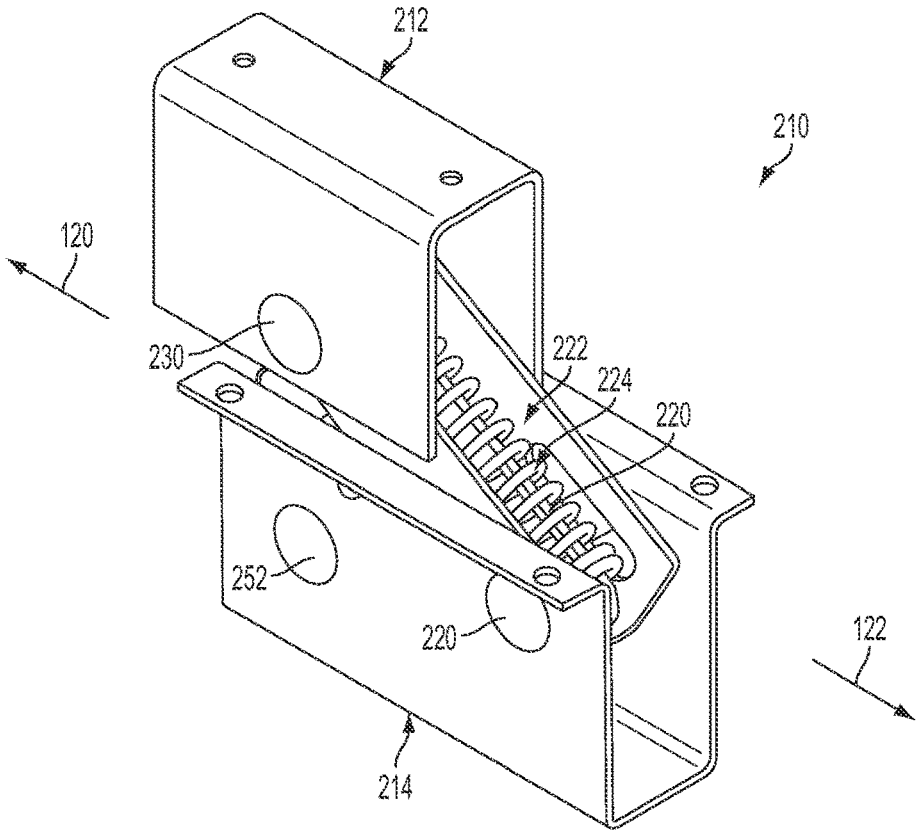
FIG. 18 illustrates an isometric view of a seal raiser assembly which raises a seal member relative to the exemplary panel of FIG. 15.
Figure 19:
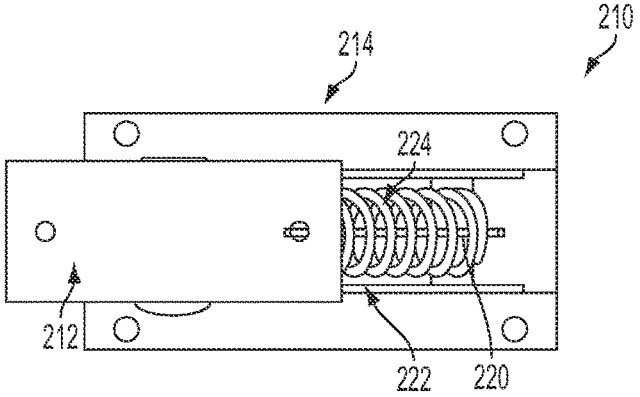
FIG. 19 illustrates a top view of the seal raiser assembly of FIG. 18.
Figure 20:
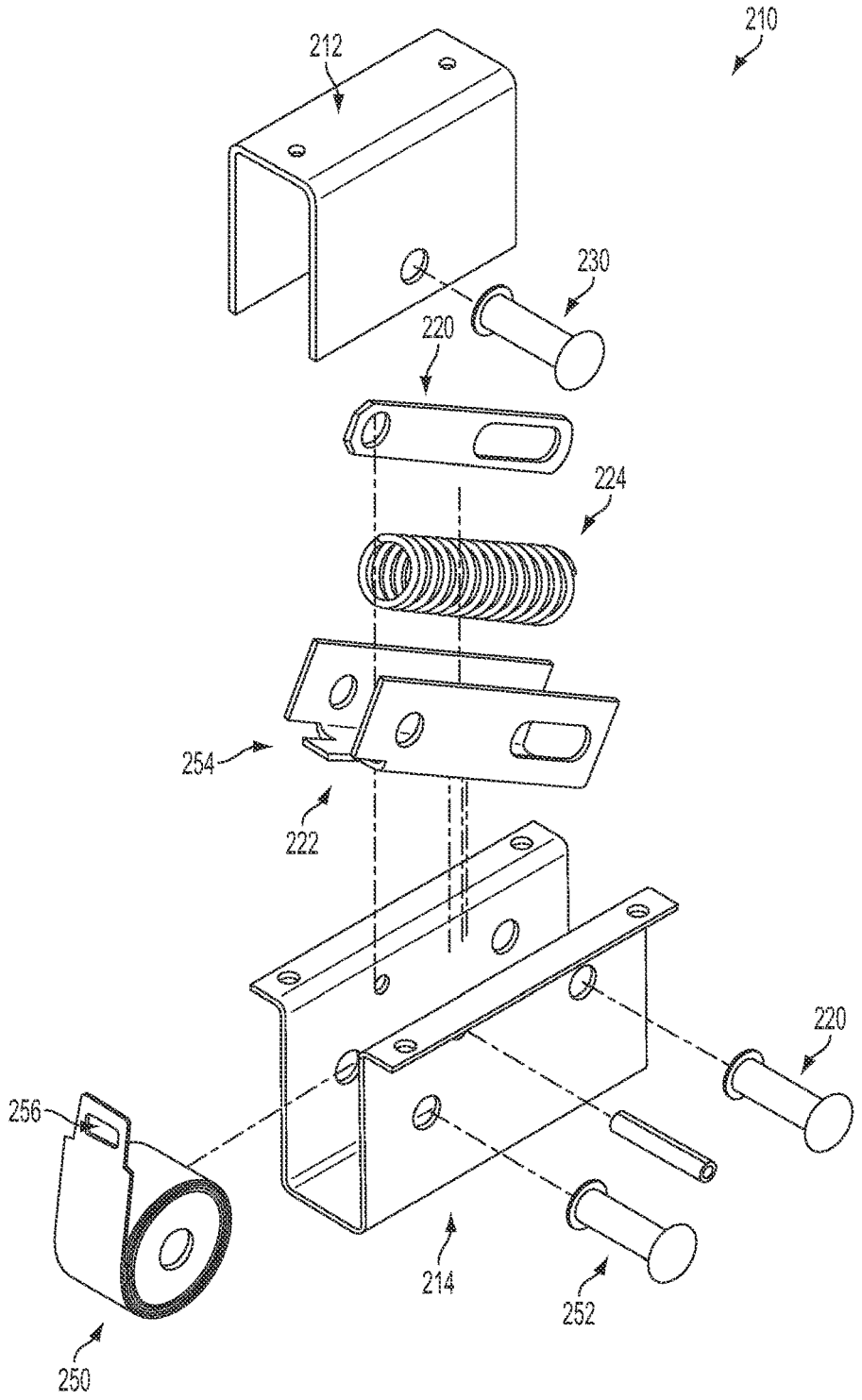
FIG. 20 illustrates an exploded assembly view of the seal raiser assembly of FIG. 18.

Referring to FIGS. 18-20, an exemplary raiser assembly 210 of automatic top seal assembly 200 is shown. Multiple raiser assemblies may be used to form automatic top seal assembly 200. Referring to FIG. 18, a first frame portion 212 of raiser assembly 210 is moveable relative to a second frame portion 214 of raiser assembly 210. The first frame portion 212 is coupled to top seal 104 and the second frame portion 214 is coupled to the frame of panel 100. As panel 100 contacts wall 116 of environment 112, first frame portion 212 moves towards trailing end 122 of panel 100. This movement results in first frame portion 212 being separated vertically further from second frame portion 214, thereby raising top seal 104 relative to panel 100.

Referring to FIG. 20, a first rivet 218 couples second frame portion 214 to a link 220. The first rivot is received by an elongated slot 219 in a link 220. The first rivot 218 also couples the second frame portion 214 to a carrier 222. The first rivot is received by an elongated slot 221 in the carrier 222. A spring 224 is positioned over link 220. A second rivet 230 couples first frame portion 212 to link 220 and carrier 222. The second rivot 230 is received in an opening 223 in first frame portion 212, opening 225 in carrier 222, and opening 227 in link 220. The spring 224 being captured over link 220 and between first rivet 218 and second rivet 230. This arrangement permits first frame portion 212 to rotate relative to second frame portion 214 and to translate upward relative to second frame portion 214.

A pin 240 is provided below carrier 222 to limit the movement of carrier 222 and hence first frame portion 212 in a downward direction. First frame portion 212 is biased in a downward direction by spring 250. Spring 250 is coupled to second frame portion 214 through a third rivet 252 received in opening 253 in second frame portion 214. Spring 250 is coupled to first frame portion 212 through an ear 254 on carrier 222 which is received in an opening 256 of spring 250.

Figure 21:
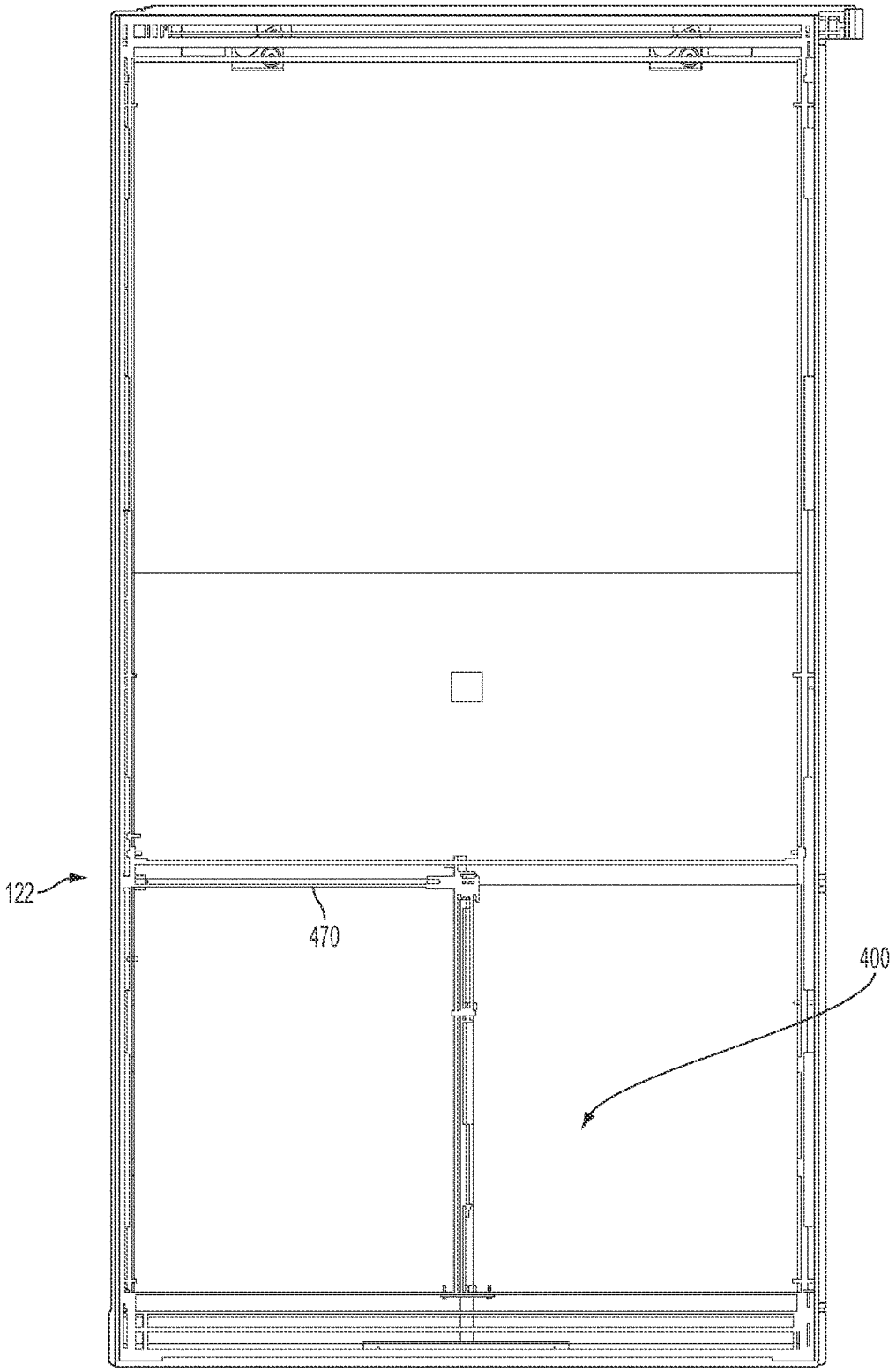
FIG. 21 illustrates an exemplary panel including a pair of seal raiser assemblies of FIG. 16 and a manually actuated bottom seal drop assembly, the bottom seal drop assembly including a damper, illustratively a gas spring, and the manually actuated bottom seal drop assembly being moved by an actuator assembly actuatable from a left side of the exemplary panel.
Figure 22:
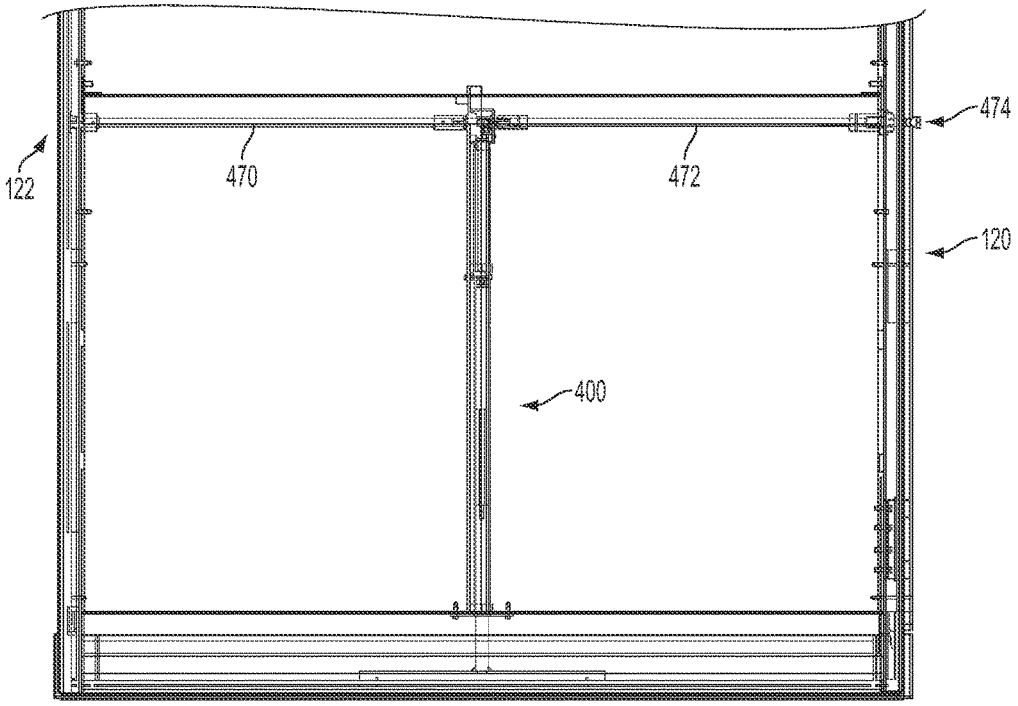
FIG. 22 illustrates a portion of a second exemplary panel generally identical to the exemplary panel of FIG. 21 and including an actuator extension which extends out of a right side of the exemplary panel to engage the actuator assembly of an adjacent panel.
Figure 23:
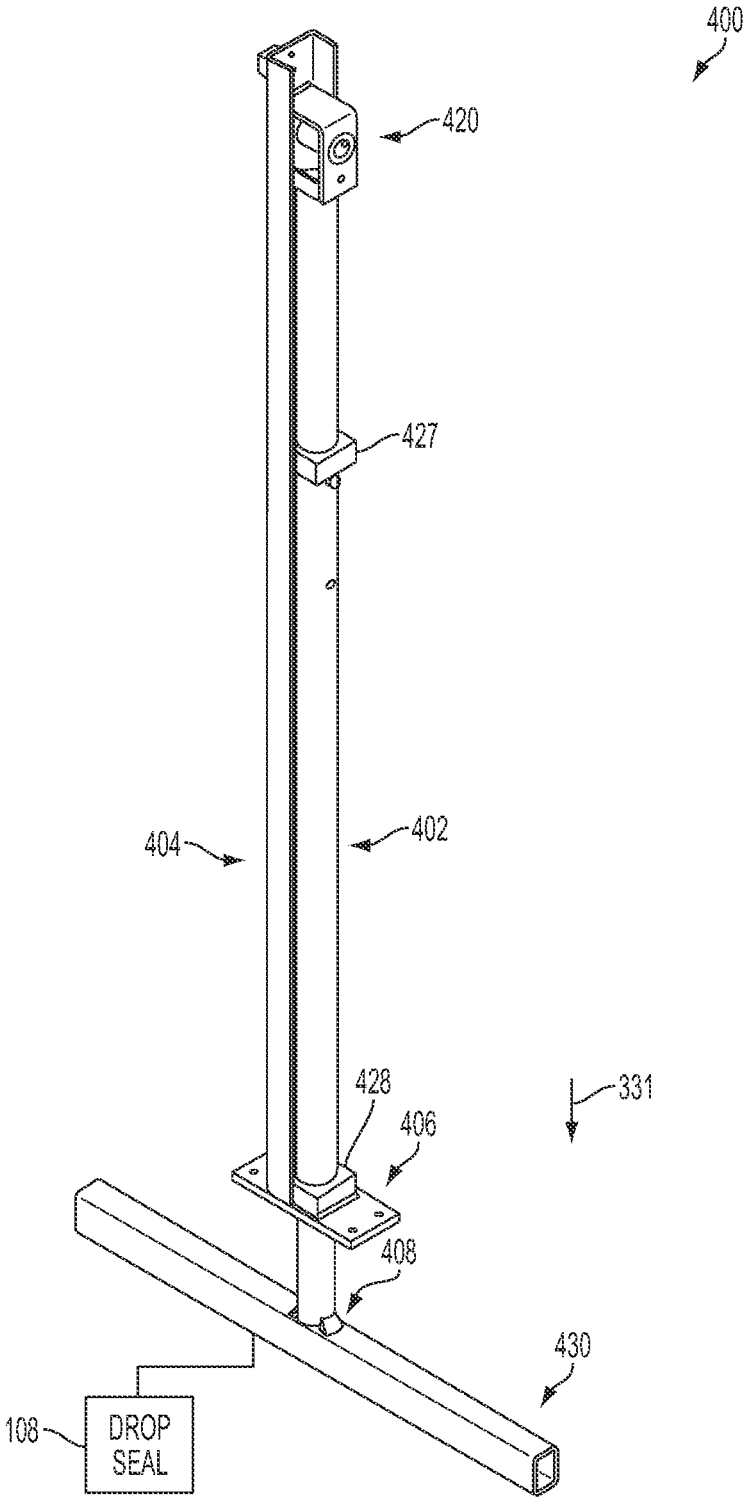
FIG. 23 illustrates an isometric view of manually actuated bottom seal drop assembly of FIG. 21.
Figure 24:
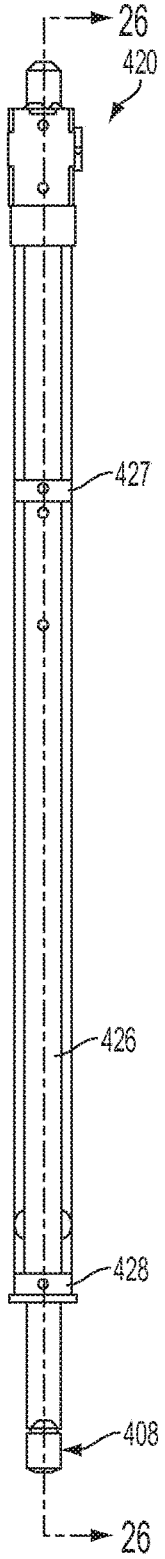
FIGS. 24 and 25 illustrates opposite side views of the manually actuated bottom seal drop assembly of FIG. 21.
Figure 25:
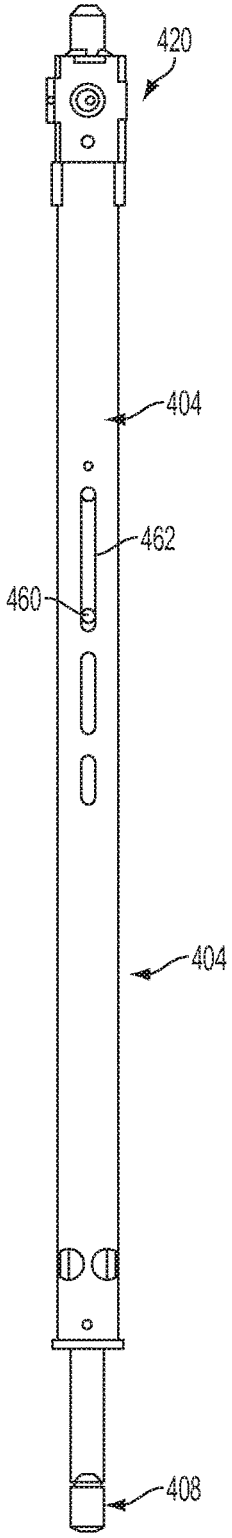

Referring to FIGS. 21-29 an exemplary manually actuated assembly 400 is shown. Referring to FIG. 23, exemplary manually actuated assembly 400 includes a first assembly 402 which is movable relative to a second assembly 404. Second assembly 404 is coupled to the frame of panel 100. In particular, plate 406 is coupled to the frame of panel 100. Second assembly 404 also includes a gearbox 420 which is coupled to an actuator accessible through one of a panel face 101 of panel 100 or an end of panel 100. As shown in FIG. 21, an actuator may couple to a shaft 470 accessible from a side 122 of panel 100. Referring to FIG. 22, the panel 100 may also include a second shaft 474 that rotates with shaft 470. The second shaft 472 has a portion 474 that extends beyond side 120 of panel 100. The portion 474 may engage an actuator input on an adjacent panel 100. As such, the drop seals 108 of multiple panels 100 may be lowered together.

Figure 26:
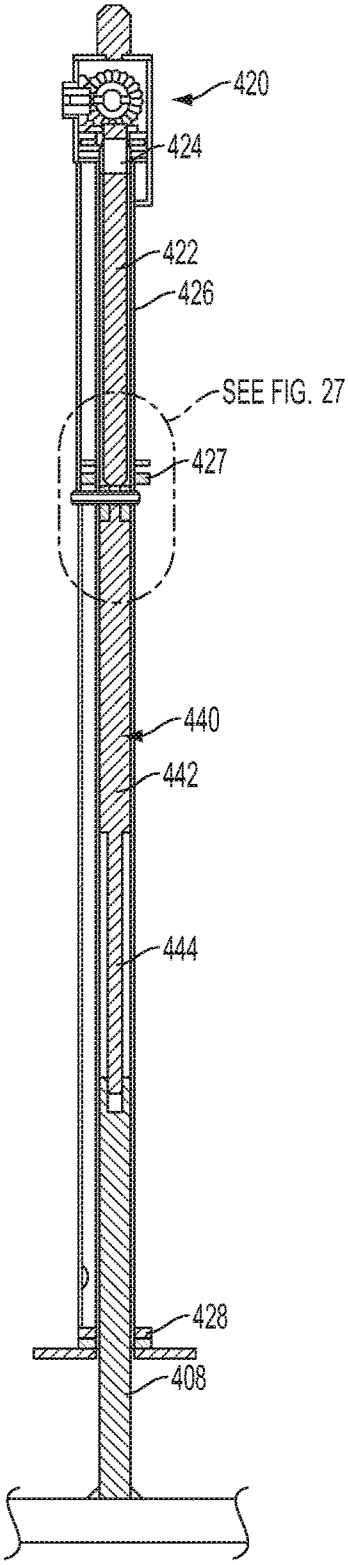
FIG. 26 illustrates a sectional view of the manually actuated bottom seal drop assembly of FIG. 21 along lines 26-26 in FIG. 24, the manually actuated bottom seal drop assembly including a damper, illustratively a gas spring.

Referring to FIG. 26, the gearbox 420 drives a lead screw 422 coupled thereto to rotate. First assembly 402 includes a lead screw nut 424 which either travels up and down the lead screw 422 during the rotation of the lead screw 422, based on a rotation direction of the lead screw 422. The movement of the lead screw nut 424 down in direction 331 (see FIG. 23) causes first assembly 402 to extend further out of plate 406 (see portion 408 in FIG. 23). This in turn lowers carrier 430 that supports drop seal 108.

As shown in FIG. 26, lead screw nut 424 is coupled to a tube 426. Tube 426 is slidable within a pair of retention blocks 427 and 428 (see FIG. 23) Also coupled to tube 426 is an adapter 428. Adapter 428 is coupled to tube 426 through a pin 460.

Figure 27:
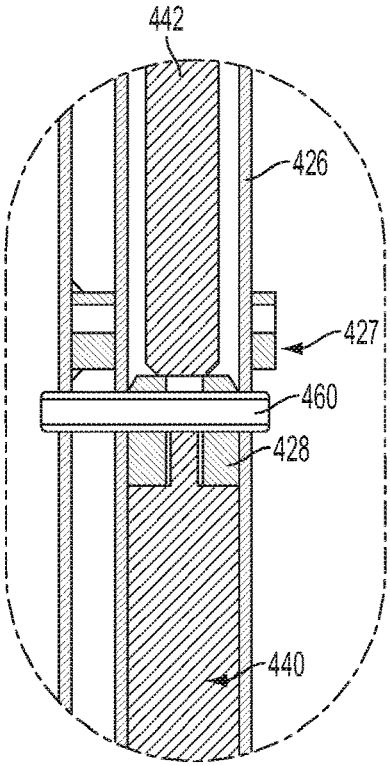
FIG. 27 illustrates a detail view of a portion of FIG. 26.

First assembly 402 further includes a gas spring 440 (see FIG. 26) which is coupled between portion 408 and the remainder of first assembly 402. As shown in FIG. 27, gas spring 440 is threadably received by adapter 428. Once drop seal 108 contacts the floor 114 of environment 112, continued downward movement of lead screw nut 424 results in a rod 444 of gas spring 440 being compressed in the cylinder 442 of gas spring 440, thereby providing a generally constant force against the floor 114 by drop seal 108.

Referring to FIG. 26, pin 460 of first assembly 402 travels in an elongated slot 462 of second assembly 404 to limit the rotation of first assembly 402 relative to second assembly 404 and to limit the vertical travel of first assembly 402 relative to second assembly 404.

In one embodiment, automatic top seal assembly 200 automatically extends when panels are set-up. No tools are required. The top seals 104 will provide 7 to 28 pounds ("lbs") of force to the track 12 depending on the coil spring 250 which is used. The top seals 104 are full width of the panel 100 and protrude no more than 3" from the lead end of the panel 100 when retracted (see FIG. 15).

In one embodiment, automatic bottom seal assembly 300 provides 120 lbs of force to the floor 114 regardless of the panels 100 clearance to the floor 114. No tools are required. The gas spring 350 used allows for loading to take place without damage to the drop seals 108 and maintaining the same force to the floor 114. The drop seal 108 may be retracted with the actuation of a latch 398 by hand. Automatic bottom seal assembly 300 applies force to the floor and may be locked at an infinite number of positions. This force is applied with the same input travel. Automatic bottom seal assembly 300 automates input force and resulting output force to the floor and track.

In one embodiment, manually actuated assembly 400 provides constant 120 lbs of force to the floor regardless of floor clearance.

In one embodiment, a movable wall panel system for suspension from an overhead track is provided. The moveable wall panel system comprising a first movable wall panel including a first end and a second end, spaced-apart from the first end, a panel face extending between the first end and the second end, a top portion which is adapted to be operatively coupled to the overhead track, and a bottom portion opposite the top portion and a second movable wall panel rotatably coupled to the first moveable wall panel, the second moveable wall panel including a first end and a second end, spaced-apart from the first end, a panel face extending between the first end and the second end, a top portion which is adapted to be operatively coupled to the overhead track, and a bottom portion opposite the top portion. The movable wall panel system further comprising a first seal supported by the first moveable wall panel and extending along the first end of the first moveable wall panel from the top portion of the first moveable wall panel to the bottom portion of the first moveable wall panel, the first seal being located at a first corner of the first moveable wall panel positioned between the first end of the first movable wall panel and the panel face the first movable wall panel; a second seal supported by the second moveable wall panel and extending along the second end of the second moveable wall panel from the top portion of the second moveable wall panel to the bottom portion of the second moveable wall panel, the second seal being located at a second corner of the second moveable wall panel positioned between the second end of the second movable wall panel and the panel face the second movable wall panel; and at least one hinge rotatably coupling the first moveable wall panel to the second moveable wall panel, the at least one hinge including a first hinge portion coupled to the first movable wall panel and a second hinge portion coupled to the second movable wall panel, wherein the first seal and the second seal cooperate to seal a gap between the first moveable wall panel and the second moveable wall panel when the panel face of the first moveable wall panel is generally coplanar with the panel face of the second movable wall panel.

In one example of the movable wall the first seal is coupled to the first moveable panel along the first end of the first moveable panel and rearward of the first corner of the first moveable panel and the second seal is coupled to the second moveable panel along the second end of the second moveable panel and rearward of the second corner of the second moveable panel.

In another example of the moveable wall a pivot axis of the at least one hinge is located forward of the first corner of the first moveable panel and forward of the second corner of the second moveable panel.

In a further example of the moveable wall, the first seal includes a first end which is spaced apart from the first corner of the first moveable panel when the first seal is spaced apart from the second seal and which is located at the first corner when the first moveable wall panel is generally coplanar with the panel face of the second movable wall panel.

In yet another example of the moveable wall, the first seal runs continuously from the top portion of the first moveable wall panel to the bottom portion of the first moveable wall panel.

In yet a further example of the moveable wall, the first seal includes a first end which is spaced apart from the first corner of the first moveable panel when the first seal is spaced apart from the second seal and which is located at the first corner when the first moveable wall panel is generally coplanar with the panel face of the second movable wall panel, the first end of the first seal being continuous from a first location positioned above the at least one hinge to a second location positioned below the at least one hinge.

In yet still another example of the movable wall, the first movable wall panel includes a mid-plane which is parallel to the panel face of the first movable wall panel, the first seal, the first hinge portion, and the panel face of the first movable wall panel all are located on a first side of the mid-plane.

In one embodiment, a movable wall panel system for suspension from an overhead track is provided. The movable wall panel system comprising a first movable wall panel including a first end and a second end, spaced-apart from the first end, a panel face extending between the first end and the second end, a top portion which is adapted to be operatively coupled to the overhead track, and a bottom portion opposite the top portion; a second movable wall panel rotatably coupled to the first moveable wall panel, the second moveable wall panel including a first end and a second end, spaced-apart from the first end, a panel face extending between the first end and the second end, a top portion which is adapted to be operatively coupled to the overhead track, and a bottom portion opposite the top portion; a first seal supported by the first moveable wall panel and extending along the first end of the first moveable wall panel from the top portion of the first moveable wall panel to the bottom portion of the first moveable wall panel; a second seal supported by the first moveable wall panel and extending along the second end of the second moveable wall panel from the top portion of the second moveable wall panel to the bottom portion of the second moveable wall panel; and at least one hinge rotatably coupling the first moveable wall panel to the second moveable wall panel, the at least one hinge including a first hinge portion coupled to the first movable wall panel at a first location rearward of a first corner of the first moveable wall panel positioned between the first end of the first movable wall panel and the panel face of the first movable wall panel and a second hinge portion coupled to the second movable wall panel at a second location rearward of a second corner of the second moveable wall panel positioned between the second end of the second movable wall panel and the panel face the second movable wall panel, wherein the first seal and the second seal cooperate to seal a gap between the first moveable wall panel and the second moveable wall panel when the panel face of the first moveable wall panel is generally coplanar with the panel face of the second movable wall panel, the first seal being coupled to the first moveable panel at a location between the first location and the first corner.

In one example of the movable wall, a pivot axis of the at least one hinge is located forward of the first corner of the first moveable panel and forward of the second corner of the second moveable panel.

In another example of the movable wall, the first seal includes a first end which is spaced apart from the first corner of the first moveable panel when the first seal is spaced apart from the second seal and which is located at the first corner when the first moveable wall panel is generally coplanar with the panel face of the second movable wall panel.

In a further example of the movable wall, the first seal runs continuously from the top portion of the first moveable wall panel to the bottom portion of the first moveable wall panel.

In yet another example of the movable wall, the first seal includes a first end which is spaced apart from the first corner of the first moveable panel when the first seal is spaced apart from the second seal and which is located at the first corner when the first moveable wall panel is generally coplanar with the panel face of the second movable wall panel, the first end of the first seal being continuous from a first location positioned above the at least one hinge to a second location positioned below the at least one hinge.

In yet still another example of the movable wall, the first movable wall panel includes a mid-plane which is parallel to the panel face of the first movable wall panel, the first seal, the first hinge portion, and the panel face of the first movable wall panel all are located on a first side of the mid-plane.

In one embodiment, a movable wall panel system for suspension from an overhead track is provided. The movable wall panel system comprising a first movable wall panel including a first end and a second end, spaced-apart from the first end, a panel face extending between the first end and the second end, a top portion which is adapted to be operatively coupled to the overhead track, and a bottom portion opposite the top portion; a second movable wall panel rotatably coupled to the first moveable wall panel, the second moveable wall panel including a first end and a second end, spaced-apart from the first end, a panel face extending between the first end and the second end, a top portion which is adapted to be operatively coupled to the overhead track, and a bottom portion opposite the top portion; at least one hinge rotatably coupling the first moveable wall panel to the second moveable wall panel, the at least one hinge including a first hinge portion coupled to the first movable wall panel and a second hinge portion coupled to the second movable wall panel; and means for sealing a gap between the first moveable wall panel and the second moveable wall panel when the panel face of the first moveable wall panel is generally coplanar with the panel face of the second movable wall panel.

In an example of the movable wall, the means includes a first seal positioned at a first corner of the first movable wall panel, the first seal, the first hinge portion and the panel face of the first movable wall panel are all located on a first side of a mid-plane of the first movable wall panel, the mid-plane of the first movable wall panel being parallel to the panel face of the first movable wall panel.

In one embodiment, a method of sealing a gap between two adjacent movable wall panels which are coupled together by at least one hinge is provided. The adjacent wall panels being located in an environment. The method comprising the steps of supporting a first seal with a first movable wall panel of the two adjacent movable wall panels, the first seal extending from above the at least one hinge to below the at least one hinge; supporting a second seal with a second movable wall panel of the two adjacent movable wall panels, the second seal extending from above the at least one hinge to below the at least one hinge; suspending the first wall movable panel and the second movable wall panel from an overhead track of the environment; and pivoting the first movable wall panel relative to the second movable wall panel such that a front panel face of the first movable wall panel is generally parallel to a front panel face of the second movable wall panel and the first seal contacts the second seal to seal the gap between the first movable wall panel and the second movable wall panel, the first seal being positioned at a first corner of the first movable wall panel and the second seal being positioned at a second corner of the second movable wall panel, the first corner being located between the front panel face of the first movable wall panel and a first end of the first movable wall panel, the first end being adjacent to the second movable wall panel, the second corner being located between the front panel face of the second movable wall panel and a second end of the second movable wall panel, the second end being adjacent to the first movable wall panel.

In one example, the method further comprises the steps of supporting a bottom seal with the first movable wall panel, the second seal being spaced apart from a floor portion of the environment; contacting the bottom seal to the floor portion of the environment; and applying a constant force between the bottom seal and the floor through a damper of the first movable wall panel.

In one embodiment, a movable wall panel system for sealing engagement relative to a ceiling portion of an environment and a floor portion of the environment is provided. The environment having an operator space positioned generally extending from the floor to a first height above the floor, the first height being spaced apart from the ceiling portion of the environment. The moveable wall panel system comprising a first movable wall panel including a first end and a second end, spaced-apart from the first end, a panel face extending between the first end and the second end, a top portion positioned proximate the ceiling portion of the environment and above the first height and a bottom portion positioned proximate the floor portion of the environment and below the first height; a top automatic seal assembly coupled to the top portion of the first moveable panel, the top automatic seal assembly including at least one seal which is moved between an unsealed configuration wherein the at least one seal is spaced apart from the ceiling portion of the environment and a sealed configuration wherein the at least one seal is sealed against the ceiling portion of the environment, the top automatic seal assembly being moved from the unsealed position to the sealed position absent an actuation of an actuator within the operator space.

In one example of the moveable wall panel system, the top automatic seal assembly includes a plurality of seal raiser assemblies, each of which raises the at least one seal.

In another example of the moveable wall panel system, the moveable wall panel system further comprises a bottom drop seal assembly coupled to the bottom portion of the first moveable panel, the bottom drop seal assembly including at least one seal which is moved between an unsealed configuration wherein the at least one seal is spaced apart from the floor portion of the environment and a sealed configuration wherein the at least one seal is sealed against the floor portion of the environment, the bottom drop seal assembly being moved from the unsealed position to the sealed position based on the actuation of the actuator within the operator space.

In a further example of the moveable wall panel system, the bottom drop seal assembly includes a damper which provides a constant force between the at least one seal of the bottom drop seal assembly and the floor when the bottom drop seal assembly is in the sealed position.

In yet another example of the moveable wall panel system, the damper is a gas spring.

In yet a further example of the moveable wall panel system, the bottom drop seal assembly is an automatic assembly.

In still another example of the moveable wall panel system, the bottom drop seal assembly is a manually actuated assembly.

In one embodiment, a movable wall panel system for sealing engagement relative to a floor portion of an environment is provided. The moveable wall panel system comprising a first movable wall panel including a first end and a second end, spaced-apart from the first end, a panel face extending between the first end and the second end, a top portion and a bottom portion positioned proximate the floor portion of the environment; a bottom drop seal assembly coupled to the bottom portion of the first moveable panel, the bottom drop seal assembly including at least one seal which is moved between an unsealed configuration wherein the at least one seal is spaced apart from the floor portion of the environment and a sealed configuration wherein the at least one seal is sealed against the floor portion of the environment, the bottom drop seal assembly including a damper which maintains a constant force between the moveable wall panel and the floor portion when the bottom seal drop assembly is in the sealed configuration.

In one example of the moveable wall panel system, the bottom drop seal assembly is a manually actuated assembly.

In another example of the moveable wall panel system, the bottom drop seal assembly is an automatic assembly.

In a further example of the moveable wall panel system, the bottom drop seal assembly first drops the at least one seal into contact with the floor portion of the environment through a first assembly followed by the application of the constant force due to the damper through a second assembly.

In yet another example of the moveable wall panel system, the damper is a gas spring.

In one embodiment, a method of sealing a gap between a moveable wall panel and a floor portion of the environment is provided. The method comprising the steps of supporting the moveable panel from an overhead track of the environment; positioning the moveable panel relative to the environment with a bottom seal of the moveable panel spaced apart from the floor portion of the environment; contacting the bottom seal to the floor; and applying a constant force between the bottom seal and the floor through a damper of the moveable panel.

In one example of the method of sealing a gap between a moveable wall panel and a floor portion of the environment, the step of applying the constant force between the bottom seal and the floor through the damper of the moveable panel includes the step of compressing the damper.

In another example of the method of sealing a gap between a moveable wall panel and a floor portion of the environment, the damper is a gas spring.

In one embodiment, a movable wall panel system for sealing engagement relative to a floor portion of an environment is provided. The moveable wall panel system comprising a first movable wall panel including a first end and a second end, spaced-apart from the first end, a panel face extending between the first end and the second end, a top portion and a bottom portion positioned proximate the floor portion of the environment; a bottom drop seal assembly coupled to the bottom portion of the first moveable panel, the bottom drop seal assembly including at least one seal which is moved between an unsealed configuration wherein the at least one seal is spaced apart from the floor portion of the environment and a sealed configuration wherein the at least one seal is sealed against the floor portion of the environment, the bottom drop seal assembly including means for maintaining a constant force between the moveable wall panel and the floor portion when the bottom seal drop assembly is in the sealed configuration independent of a separation distance between the floor portion and the at least one seal in the unsealed configuration.

While this disclosure has been described as having exemplary designs and embodiments, the present systems and methods may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. A movable wall panel system for sealing engagement relative to a floor of an environment, the movable wall panel system comprising:

a movable wall panel including a first end and a second end spaced-apart from the first end, a panel face extending between the first end and the second end, a top portion and a bottom portion, the bottom portion positioned proximate the floor of the environment; and a bottom drop seal assembly coupled to the bottom portion of the movable wall panel, the bottom drop seal assembly including at least one seal which is movable between an unsealed configuration wherein the at least one seal is spaced apart from the floor of the environment and a plurality of sealed configurations, wherein the at least one seal is sealable against the floor of the environment in a first one of the plurality of sealed configurations at a first distance from the unsealed configuration and the at least one seal is sealable against the floor of the environment in a second one of said plurality of sealed configurations at a second distance from the unsealed configuration, the bottom drop seal assembly including a damper which maintains a generally constant force between the movable wall panel and the floor of the environment when the at least one seal is in any one of the plurality of sealed configurations, the generally constant force between the movable wall panel and the floor of the environment is maintained whether the at least one seal seals against the floor of the environment in the first one of the plurality of sealed configurations or in the second one of the plurality of sealed configurations, whereby the movable wall panel system may be positioned relative to the floor of the environment at a first position such that the at least one seal is sealed against the floor of the environment in the first one of the plurality of sealed configurations at the first distance from the unsealed configuration with the generally constant force between the movable wall panel and the floor of the environment, and whereby the movable wall panel system may be positioned relative to the floor of the environment at a second position such that the at least one seal is sealed against the floor of the environment in the second one of the plurality of sealed configurations at the second distance from the unsealed configuration with the generally constant force between the movable wall panel and the floor of the environment.

2. The movable wall panel system of claim 1, wherein the bottom drop seal assembly is an automatic assembly.

3. The movable wall panel system of claim 1, wherein the bottom drop seal assembly drops the at least one seal into contact with the floor of the environment through a first assembly followed by an application of the generally constant force from the damper through a second assembly.

4. The movable wall panel system of claim 3, wherein the first assembly drops the at least one seal into contact with the floor of the environment through a mechanical assembly, the damper being supported by the mechanical assembly.

5. The movable wall panel system of claim 1, wherein the damper is a gas spring.

6. The movable wall panel system of claim 5, wherein the bottom drop seal assembly maintains the generally constant force between the movable wall panel and the floor of the environment when the at least one seal is in any one of the plurality of sealed configurations independent of a separation distance between the floor and the at least one seal in the unsealed configuration.

7. The movable wall panel system of claim 1, wherein the damper includes a subassembly having a piston and a cylinder, the piston being reciprocatable within a cavity of the cylinder, a first portion of the subassembly being coupled to the movable wall panel and a second portion of the subassembly coupled to the seal, the piston moving in the cylinder as the seal moves relative to the bottom portion of the movable wall panel.

8. The movable wall panel system of claim 1, further comprising a second movable wall panel including a leading end and a trailing end spaced apart from the leading end;

a second bottom drop seal assembly coupled to a bottom portion of the second movable wall panel, the second bottom drop seal assembly including at least one seal which is moved between an unsealed configuration wherein the at least one seal of the second bottom drop seal assembly is spaced apart from the floor of the environment and a sealed configuration wherein the at least one seal of the second bottom drop seal assembly is sealed against the floor of the environment, the second bottom drop seal assembly including a second damper which maintains a generally constant force between the second movable wall panel and the floor of the environment when the at least one seal of the second bottom drop seal assembly is in the sealed configuration; and an actuator assembly coupled to the second bottom drop seal assembly, the actuator assembly can move the at least one seal of the second bottom drop seal assembly from the unsealed configuration to the sealed configuration.

9. The movable wall panel system of claim 8, wherein the actuator assembly includes an input positioned proximate the trailing end of the second movable wall panel and the movable wall panel supports an actuator, wherein as the movable wall panel is moved towards the second movable wall panel, the actuator supported by the movable wall panel actuates the actuator assembly input resulting in the actuator assembly causing the at least one seal of the second bottom drop seal assembly to move from the unsealed configuration to the sealed configuration.

10. A movable wall panel system for sealing engagement relative to a floor of an environment, the movable wall panel system comprising:

a movable wall panel including a first end and a second end spaced-apart from the first end, a panel face extending between the first end and the second end, a top portion and a bottom portion, the bottom portion positioned proximate the floor of the environment;

a bottom drop seal assembly coupled to the bottom portion of the movable wall panel, the bottom drop seal assembly including at least one seal which is movable between an unsealed configuration wherein the at least one seal is spaced apart from the floor of the environment and a sealed configuration wherein the at least one seal is sealed against the floor of the environment, the bottom drop seal assembly including means for maintaining a generally constant force between the movable wall panel and the floor of the environment when the seal is in the sealed configuration independent of a separation distance between the floor and the at least one seal in the unsealed configuration, the means for maintaining the generally constant force between the movable wall panel and the floor of the environment automatically maintaining the generally constant force between the movable wall panel and the floor of the environment whether the seal, in the sealed configuration, is spaced a first distance from the seal in the unsealed configuration or the seal, in the sealed configuration, is spaced a second distance from the seal in the unsealed configuration.

11. The movable wall panel system of claim 10, wherein the means for maintaining the generally constant force between the movable wall panel and the floor of the environment includes a subassembly having a piston and a cylinder, the piston being reciprocatable within a cavity of the cylinder, a first portion of the subassembly being coupled to the movable wall panel and a second portion of the subassembly coupled to the seal, the piston moving in the cylinder as the seal moves relative to the bottom portion of the movable wall panel.

* * * * *